US007166824B2

(12) United States Patent
Kanzaki et al.

(10) Patent No.: US 7,166,824 B2
(45) Date of Patent: Jan. 23, 2007

(54) HIGH-FREQUENCY HEATING APPARATUS AND CONTROL METHOD THEREOF

(75) Inventors: Kouji Kanzaki, Yamatokoriyama (JP); Yuji Hayakawa, Shiki-gun (JP); Satomi Uchiyama, Nara (JP); Kenji Watanabe, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 235 days.

(21) Appl. No.: 10/432,919

(22) PCT Filed: Jan. 8, 2003

(86) PCT No.: PCT/JP03/00081

§ 371 (c)(1),
(2), (4) Date: May 28, 2003

(87) PCT Pub. No.: WO03/077605

PCT Pub. Date: Sep. 18, 2003

(65) Prior Publication Data

US 2004/0232140 A1 Nov. 25, 2004

(30) Foreign Application Priority Data

Mar. 12, 2002 (JP) ..... 2002-067036
Jun. 5, 2002 (JP) ..... 2002-164836

(51) Int. Cl.
*H05B 6/80* (2006.01)

(52) U.S. Cl. ..... 219/682; 219/440; 219/686

(58) Field of Classification Search ..... 219/682, 219/686, 687, 401, 440, 707, 710, 716, 711; 426/233; 432/219
See application file for complete search history.

(56) References Cited

U.S. PATENT DOCUMENTS

| | | | | |
|---|---|---|---|---|
| 3,654,417 | A * | 4/1972 | Javes et al. | 219/757 |
| 4,096,369 | A * | 6/1978 | Tanaka et al. | 219/741 |
| 4,366,357 | A | 12/1982 | Satoh | |
| 4,454,404 | A | 6/1984 | Zushi | |
| 4,553,011 | A * | 11/1985 | Nakata et al. | 219/711 |
| 5,525,782 | A * | 6/1996 | Yoneno et al. | 219/682 |
| 5,530,229 | A * | 6/1996 | Gong et al. | 219/711 |
| 5,767,487 | A * | 6/1998 | Tippmann | 219/440 |
| 6,008,482 | A * | 12/1999 | Takahashi et al. | 219/687 |
| 6,121,596 | A * | 9/2000 | Taino et al. | 219/711 |
| 6,133,558 | A * | 10/2000 | Ueda et al. | 219/682 |
| 6,497,907 | B1 * | 12/2002 | Hofer | 426/233 |

FOREIGN PATENT DOCUMENTS

| | | |
|---|---|---|
| EP | 1 148 763 A2 | 10/2001 |
| EP | 1 148 765 A2 | 10/2001 |

(Continued)

*Primary Examiner*—Quang Van
(74) *Attorney, Agent, or Firm*—Pearne & Gordon LLP

(57) ABSTRACT

The present invention relates to a high-frequency heating apparatus with steam generation function and control method thereof. When high-frequency heating treatment for heat-treating with a high frequency and steam heating treatment for heat-treating with steam generated in a heating chamber are performed in order separately or at the same time for heat-treating the heated material, while air in the heating chamber is agitated, the air is circulated in the heating chamber. An appropriate heating program is automatically selected in response to the type of heated material to perform heat treatment.

20 Claims, 31 Drawing Sheets

FOREIGN PATENT DOCUMENTS

| | | | |
|---|---|---|---|
| FR | 2 571 830 | | 4/1986 |
| GB | 2 324 889 | A | 11/1998 |
| JP | 54-115448 | | 9/1979 |
| JP | 54-127769 | | 10/1979 |
| JP | 56-10260 | | 8/1981 |
| JP | 56-68806 | | 10/1981 |
| JP | 59-225224 | | 12/1984 |
| JP | 61-11296 | | 1/1986 |
| JP | 2-195 | | 1/1990 |
| JP | 3-6203 | | 1/1991 |
| JP | 8-178298 | | 7/1996 |
| JP | 9-4849 | | 1/1997 |
| JP | 2002-48344 | | 2/2002 |
| JP | 2002048344 | A * | 2/2002 |
| JP | 2002-115850 | | 4/2002 |
| JP | 2002-156120 | | 5/2002 |
| JP | 2003-21337 | | 1/2003 |

* cited by examiner

HEATING START
HEATING END

STEAM GENERATION S
CIRCULATION FAN F
CHAMBER AIR HEATER H
HIGH-FREQUENCY HEATING M

STEAM GENERATION S
CIRCULATION FAN F
CHAMBER AIR HEATER H
HIGH-FREQUENCY HEATING M

STEAM GENERATION S
CIRCULATION FAN F
CHAMBER AIR HEATER H
HIGH-FREQUENCY HEATING M

STEAM GENERATION S
CIRCULATION FAN F
CHAMBER AIR HEATER H
HIGH-FREQUENCY HEATING M

FIG. 36

| HEATING CHAMBER VOLUME [ l ] | AMOUNT OF WATER IN EVAPORATION PAN [ ml ] | | | | | | |
|---|---|---|---|---|---|---|---|
| | 10 ~ 20 | 21 ~ 30 | 31 ~ 40 | 41 ~ 50 | 51 ~ 60 | | |
| ~ 10 | A-1 | A-2 | A-3 | A-4 | A-5 | | |
| 11 ~ 15 | B-1 | B-2 | B-3 | B-4 | B-5 | | |
| 16 ~ 20 | C-1 | C-2 | C-3 | C-4 | C-5 | | |
| 21 ~ 25 | D-1 | D-2 | D-3 | D-4 | D-5 | | |
| 26 ~ 30 | E-1 | E-2 | E-3 | E-4 | E-5 | | |

HIGH-FREQUENCY HEATING APPARATUS AND CONTROL METHOD THEREOF

TECHNICAL FIELD

The invention relates to a heating control method of a high-frequency heating apparatus with steam generation function and the high-frequency heating apparatus with steam generation function for heat-treating a material to be heated (herein after, heated material) using high-frequency heating and steam heating in combination.

BACKGROUND ART

Hitherto, to heat a heated material of food, etc., first the heated material has been placed in a heating chamber, a high-frequency heating switch has been pressed for starting heating, and when the specified predetermined time has elapsed or the heated material has reached a predetermined finish temperature, the heating has been stopped and then the heated material has been taken out. However, a heated material generating steam as the material is heated is deprived of moisture by high-frequency heating, and the surface of the heated material is dried or hardened. Then, to suppress a decrease in the moisture content by high-frequency heating, for example, the heated material is wrapped in wrap film (thin film for wrapping food) and heating treatment is performed so that steam does not escape.

As the heating conditions of the heating time, the output value of high-frequency heating, etc., for example, the weight of the heated material is detected and the condition is controlled to the heating amount matching the weight, or the temperature of the heated material during heating is detected by an infrared sensor and the condition is controlled so as to prevent overheating.

Further, the conventional high-frequency heating apparatus include a microwave oven including a high-frequency generator for heating, a combination cooking range including a convection heater for generating a hot wind, added to the microwave oven, and the like. A steamer for introducing steam into a heating chamber and heating, a steam convection oven including a convection heater added to the steamer, and the like are also used as cooking utensils.

To cook an article of food, etc., with the cooking utensil, the cooking utensil is controlled so that the heated finish state of the food article becomes the best. That is, cooking using high-frequency heating and hot-wind heating in combination can be controlled with a combination cooking range and cooking using steam heating and hot-wind heating in combination can be controlled with a steam convection oven. However, cooking using high-frequency heating and steam heating in combination involves time and labor of performing each heat treatment with the heated food transferred between separate cooking utensils. To eliminate the inconvenience, one cooking utensil that can accomplish high-frequency heating, steam heating, and electric heating is available. This cooking utensil is disclosed, for example, in Japanese Unexamined Patent Publication No. Sho 54-115448.

However, it is bothersome for the operator to wrap a heated material in wrap in each heating, and caution needs also to be taken in removing the wrap at the heating termination time from the viewpoint of the heated material at a high temperature, resulting in burdensome heating work. Then, various types of high-frequency heating apparatus with a steam generation function in addition to a high-frequency heating function are considered. According to such a high-frequency heating apparatus with a steam generation function, high-frequency heating is performed with a heating chamber filled with steam, whereby the heated material can be heated without depriving the heated material of moisture; on the other hand, if the heating chamber is filled with steam, an infrared sensor measures the temperature of the filled steam particles and it is made impossible to accurately detect the temperature of the food; this is a problem.

In a high-frequency heating apparatus of turn table type, a weight sensor is attached to the rotation shaft of a turn table for measuring the weight of a heated material, and optimum heating treatment responsive to the weight of the heated material is conducted. On the other hand, a technique is available wherein a high frequency generated by a magnetron is applied to a rotated stirrer blade and is spread into a heating chamber for the purpose of effectively using the inside of the heating chamber. In this technique, the heated material is placed directly on the bottom of the heating chamber and thus a weight sensor as in the turn table type cannot be attached and therefore a problem of incapability of directly measuring the quantity of the heated material occurs.

Further, in a cooking utensil provided with a temperature sensor such as an infrared sensor for measuring the temperature of a heated material, if a heating chamber fills with steam, the infrared sensor measures the temperature of the suspended particles of the steam existing in space with the heated material rather than the temperature of the heated material, as described above. Thus, it is made impossible to precisely measure the temperature of the heated material. Then, heating control performed based on the temperature detection result of the infrared sensor does not normally operate and a defective condition of insufficient heating, successive heating, etc., for example, occurs. Particularly, to perform automatic cooking in a sequential procedure, the procedure proceeds to the next step as the heat failure remains; simple re-heating, standing to cool, etc., cannot overcome it and there is also a possibility that the cooking will result in failure.

As a control method for cooking with steam heating and high-frequency heating in association in the publication, the point of switching from high-frequency heating to steam heating and the point of performing both the steam heating and the high-frequency heating at the same time only within a predetermined time at the switching time. However, the disclosure of the publication does not reach the level at which an appropriate heating program is automatically selected and executed in response to the type of object to be heated. Therefore, if a plurality of heating programs are provided, the operator must determine which heating program is to be selected for cooking.

When steam heating and high-frequency heating are performed at the same time, the amount of electric power for heating increases and thus most of rated power is consumed for the high-frequency heating and the amount of electric power for the vapor heating essentially required cannot be covered. Therefore, insufficient steam heating can only be performed and a restriction is placed on the cooking; this is a problem. Thus, as shown in FIG. 38, often, in fact, each heating is switched on and off in a short time under pulse control, thereby suppressing the instantaneous total used electric power (amount of electric power for steam heating, a, +amount of electric power for high-frequency heating, b). However, each heating becomes intermittent and thus the heating efficiency is degraded and it is made impossible to make full use of the essential heating capability. Consequently, the heating time increases and the total power consumption also tends to increase.

The user may visually check the heated material for the heated condition through a window of a door of a heating chamber. Particularly, to perform steam heating, condensation occurs on the window and often it is made impossible for the user to peep into the heating chamber; it is feared that the ease of use may be degraded.

It is therefore an object of the invention to provide a heating control method of a high-frequency heating apparatus and the high-frequency heating apparatus for making it possible to supply steam to a heating chamber, perform high-frequency heating, and precisely detect the heating temperature of a heated material by an infrared sensor.

Further, an object of the invention to provide a control method of a high-frequency heating apparatus with steam generation function for making it possible to perform appropriate heating treatment by measuring the temperature of a heated material precisely, automatically select an optimum heating program in response to the type of heated material, ensure the maximum heating efficiency within rated power, and enhance the ease of use.

DISCLOSURE OF THE INVENTION

According to the present invention, there is provided a control method of a high-frequency heating apparatus with steam generation function for supplying a high frequency and steam to a heating chamber for storing a heated material and heat-treating the heated material, characterized in that when high-frequency heating treatment for heat-treating with a high frequency and steam heating treatment for heat-treating with steam generated in the heating chamber are performed in order separately or at the same time for heat-treating the heated material, while air in the heating chamber is agitated, the air is circulated in the heating chamber.

In the control method of the high-frequency heating apparatus with steam generation function, the air in the heating chamber is circulated while it is agitated at the heating treatment time and thus steam can be spread uniformly to the corners of the heating chamber. Therefore, although the heating chamber is filled with steam, the steam does not build up and is spread in the heating chamber. Consequently, the temperature measurement accuracy of the heated material, for example, by an infrared sensor can also be enhanced, and proper heating treatment can be performed at high speed.

Preferably, at the heating treatment time, the air circulated in the heating chamber is heated by a chamber air heater.

In the control method of the high-frequency heating apparatus with steam generation function, the air circulated in the heating chamber is heated by the chamber air heater, so that the temperature of the steam generated in the heating chamber can be raised as desired. For example, the steam temperature can be raised to 100° C. or more. Therefore, the temperature of the heated material can be raised efficiently with overheated steam, and the heated material can also be made to get burned with high-temperature steam. The heating time of the heated material can be shortened.

Further, at the heating treatment time, the temperature in the heating chamber is measured by a temperature detection sensor, the temperature measurement result is stored in a storage section, determination temperature preset in the storage section is compared with the temperature measurement result, if the temperature measurement result is higher than the determination temperature, a heating program for performing high-frequency heating treatment and then switching to steam heating treatment for heating the heated material is selected, if the temperature measurement result is equal to or less than the determination temperature, a heating program for performing high-frequency heating treatment and steam heating treatment at the same time and then stopping only the high-frequency heating treatment and executing the steam heating treatment to heat the heated material is selected, and the heated material is heat-treated based on the selected heating program.

In the control method of the high-frequency heating apparatus with steam generation function, a frozen article and a refrigerated article are automatically distinguished from each other according to the measurement result of the temperature detection sensor, and the heating method is changed in response to the distinguishing result. That is, if the measured temperature is higher than the determination temperature, the heated material is determined a refrigerated article and the heating program for performing high-frequency heating treatment and then switching to steam heating treatment for heating the heated material is executed. If the measured temperature is equal to or less than the determination temperature, the heated material is determined a frozen article and the heating program for performing high-frequency heating treatment and steam heating treatment at the same time and then stopping only the high-frequency heating treatment and executing the steam heating treatment to heat the heated material is executed.

Generally, high frequency has the nature that it is absorbed in water molecules and is hard to penetrate into ice. The frozen food has a high percentage of containing ice and steam heating is more effective than high-frequency heating at least until ice thaws. Therefore, to heat-treat a frozen article, the heating program for performing high-frequency heating treatment and then switching to steam heating treatment for heating the heated material is executed, whereby the heating efficiency and the heating speed can be increased. If steam heating is performed, steam is deposited on the surface of the heated material, thereby transferring the heat quantity of the steam to the heated material, and when the steam condenses on the surface of the heated material, latent heat occurs and efficiently raises the temperature of the heated material. Therefore, to heat a refrigerated article, the heating program for performing high-frequency heating treatment and then switching to steam heating treatment for heating the heated material is executed, whereby the heating efficiency and the heating speed can be increased.

Still further, the high-frequency heating treatment is heating treatment in which an inverter variably controls the heating power amount, and that the steam heating treatment and the high-frequency heating treatment are performed at the same time so that the sum of the heating power amount of the steam heating treatment and the chamber air heater and the heating power amount of the high-frequency heating treatment becomes a predetermined rated power amount or less.

In the control method of the high-frequency heating apparatus with steam generation function, when the steam heating treatment and the high-frequency heating treatment are performed at the same time, the heating power amounts of both the steam heating treatment and the high-frequency heating treatment are variably controlled by inverter control, whereby the sum of the power amount required for the steam heating and the power amount required for the high-frequency heating is suppressed to the predetermined rated power amount or less, so that the steam heating and the high-frequency heating can be performed consecutively and thus the heating efficiency can be enhanced and the heating time can be shortened and consequently, the total power consumption can be decreased.

Further, the heating chamber has an outlet with a door comprising a light-transmitting window in a part in a manner that it can be opened and closed and an air outlet for blowing outside air on the window of the door on the heating chamber inside is disposed on a side wall of the heating chamber, and that blowing outside air on the window of the door is started at a predetermined time period before the heating termination time at which both the steam heating treatment and the high-frequency heating treatment are complete.

In the control method of the high-frequency heating apparatus with steam generation function, fogging on the door can be removed on the point of terminating the heating treatment, and viewability in the heating chamber is enhanced. Moreover, blowing of steam on the front from the inside when the door is opened can be suppressed and the safety can be enhanced.

According to the present invention, there is provided a heating control method of a high-frequency heating apparatus for supplying at least either of a high frequency and steam to a heating chamber for storing a heated material and heat-treating the heated material and on the other hand, measuring temperature of the heated material by an infrared sensor and monitoring the heating state, the heating control method comprising the steps of measuring the temperature of the heated material by the infrared sensor a plurality of times and finding the temperature rise rate to the heating time of the heated material at the initial humidification time at which steam is supplied to the heating chamber and low-output heating with a high frequency is performed; after the termination of the initial humidification, stopping supplying steam to the heating chamber and performing high-frequency main heating according to the heating condition responsive to the quantity of the heated material estimated from the temperature rise rate; and when the infrared sensor detects the specified finish temperature of the heated material during the high-frequency main heating, stopping the high-frequency main heating.

In the heating control method of the high-frequency heating apparatus, steam is supplied to the heating chamber, low-output heating with a high frequency is performed, the steam concentration in the heating chamber is raised in the range in which the infrared sensor can detect the temperature of the heated material, the infrared sensor detects temperature rise of the heated material, the initial temperature of the heated material is found, and temperature measurement is conducted a plurality of times for finding the temperature rise rate of the heated material. The quantity of the heated material is estimated from the temperature rise rate, the heating conditions of the output value of high-frequency heating, etc., are set in response to the estimated quantity, and high-frequency main heating is performed. At this time, supplying steam to the heating chamber is stopped for suppressing an increase in the steam concentration in the heating chamber more than necessary, and the steam concentration is left in the range in which the infrared sensor can detect the temperature of the heated material at the high-frequency main heating time. As supplying the steam is stopped, it is made possible to consume up to roughly the maximum output of the apparatus for output of the high-frequency main heating, and the output variable range of the high-frequency main heating is enlarged. When the infrared sensor detects the finish temperature of the heated material, the high-frequency main heating is stopped. Thus, the temperature measurement is conducted while the heating chamber is at low steam concentration, and steam generation is stopped for lowering the steam concentration during the high-frequency main heating for controlling so that when the temperature measurement is conducted, the heating chamber becomes low steam concentration, whereby the infrared sensor can precisely measure the temperature of the heated material and it is made possible to heat the heated material without depriving the heated material of moisture.

Preferably, when the quantity of the heated material is large, the execution time of the initial humidification is set to a long time and when the quantity of the heated material is small, the execution time of the initial humidification is set to a short time.

In the heating control method of the high-frequency heating apparatus, when the quantity of the heated material is large, the humidification time is prolonged, whereby necessary and sufficient moisture is supplied to the heating chamber and drying the heated material at the heating time is eliminated. When the quantity is small, the humidification time is shortened, whereby the steam concentration in the heating chamber is prevented from being made large more than necessary and fruitless heating time can be reduced, so that efficient heating treatment can be performed.

Further, whether the heated material is a frozen article or an article stored at room temperature is determined from the temperature measurement result of the infrared sensor at the initial humidification time and if the heating material is a frozen article, heating at the high-frequency main heating time is set as stronger heating than that if the heating material is an article stored at room temperature.

In the heating control method of the high-frequency heating apparatus, if the heating material is a frozen article, heating of the frozen article is set as stronger heating than that of an article stored at room temperature, whereby heating treatment responsive to the type of heated material can be performed and insufficient heating or overheating can be prevented from occurring. Therefore, appropriate heating treatment can be performed regardless of the frozen article or the article stored at room temperature.

Moreover, when the infrared sensor detects the finish temperature, additional steam is supplied to the heating chamber for a predetermined time in at least any one of the cases where (1) temperature unevenness caused by heating the heated material exceeds a predetermined allowed value;

(2) the heated material is a frozen article;

(3) the quantity of the heated material exceeds a stipulated amount.

In the heating control method of the high-frequency heating apparatus, if heating of the heated material is insufficient, when the finish temperature is detected, additional steam is supplied to the heating chamber for placing the heated material in good finish state and if moisture is evaporated by high-frequency main heating, the heated material can be replenished with moisture.

Furthermore, the supply time of the additional steam is set in proportion to the heating time of the high-frequency main heating.

In the heating control method of the high-frequency heating apparatus, if the time of the high-frequency main heating is short, the supply time of additional steam is set to a short time; if the time of the high-frequency main heating is long, the supply time of additional steam is set to a long time. Accordingly, adequate humidification responsive to the heating condition can be executed.

Still further, when the additional steam is supplied to the heating chamber, low-output heating with a high frequency is performed together.

In the heating control method of the high-frequency heating apparatus, high-frequency heating is performed with steam supply, so that heating is also promoted from the inside of the heated material and the whole heated material can be placed in a uniform temperature distribution with no temperature unevenness.

Further, air in the heating chamber is agitated by a circulation fan at the same time as the high-frequency main heating time.

In the heating control method of the high-frequency heating apparatus, the air in the heating chamber is agitated with the steam supply stopped at the high-frequency main heating time, whereby steam is blown on the heated material for uniforming the humidification and heating effects and the steam with which the heating chamber fills is condensed on the wall of the heating chamber, etc., for gradually lowering the steam concentration, and the steam concentration can be placed early in the steam concentration range in which the infrared sensor can precisely conduct temperature measurement.

Furthermore, air in the heating chamber is agitated by a circulation fan at the same time as the initial humidification time.

In the heating control method of the high-frequency heating apparatus, the air in the heating chamber is agitated at the initial humidification time, whereby if the heating chamber fills with steam when the apparatus is used consecutively, the steam is agitated and temperature measurement of the infrared sensor can be conducted precisely.

Further, the maximum heating time responsive to the quantity of the heated material is set and when the elapsed time since the heating start reaches the maximum heating time, the heating treatment is forcibly terminated.

In the heating control method of the high-frequency heating apparatus, the heating treatment is forcibly terminated when the maximum heating time responsive to the quantity of the heated material has elapsed, whereby overheating of the heated material or the apparatus itself when the operation of the apparatus is abnormal is prevented, so that the safety of the high-frequency heating apparatus can be maintained.

According to the present invention, there is provided a heating control method of a high-frequency heating apparatus for supplying at least either of a high frequency and steam to a heating chamber for storing a heated material and heat-treating the heated material and on the other hand, measuring the temperature of the heated material by an infrared sensor and monitoring the heating state, characterized in that the temperature measurement of the heated material conducted by the infrared sensor is performed within preset measurement time after the heating start.

In the heating control method of the high-frequency heating apparatus, the temperature measurement of the heated material conducted by the infrared sensor is performed within the preset measurement time in a state in which the steam concentration in the heating chamber is comparatively low after the heating start, so that the temperature of the heated material can be measured more precisely.

Preferably, the temperature measurement limit time of the infrared sensor changing in response to at least any of the volume of the heating chamber, the amount of water supplied for steam generation, or an output value of a heating source for heating the water is found, each found temperature measurement limit time is registered in a table, and the table is referenced for setting the measurement time.

In the heating control method of the high-frequency heating apparatus, the table in which the temperature measurement limit time changing in response to each condition is previously found for each of various conditions is referenced for setting the measurement time, so that the temperature measurement can be terminated within the time responsive to the heating condition and temperature detection not affected by steam can be executed more reliably.

According to the present invention, there is provided a heating control method of a high-frequency heating apparatus for supplying at least either of a high frequency and steam to a heating chamber for storing a heated material and heat-treating the heated material and on the other hand, measuring the temperature of the heated material by an infrared sensor and monitoring the heating state, comprising the steps of, when the steam concentration in the heating chamber exceeds the temperature detection possible range of the heated material by the infrared sensor, stopping the temperature measurement of the infrared sensor or invalidating the measured temperature, after the steam concentration lowers within the temperature detection possible range, starting the temperature measurement of the infrared sensor or validating the measured temperature, and measuring the temperature of the heated material.

In the heating control method of the high-frequency heating apparatus, as steam is supplied, when the steam concentration in the heating chamber exceeds the temperature detection possible range of the heated material by the infrared sensor, the temperature measurement of the infrared sensor is stopped or the measured temperature is invalidated, after the steam concentration lowers within the temperature detection possible range, the temperature measurement of the infrared sensor is started or the measured temperature is validated, the temperature of the heated material can be precisely measured without being affected by the steam in the heating chamber.

Preferably, the adjustment time until the steam concentration lowers in the temperature detection possible range is found in response to various conditions in the heating chamber, each found adjustment time is registered in a table, and the table is referenced for setting the adjustment time.

In the heating control method of the high-frequency heating apparatus, the table in which the adjustment time changing in response to the condition in the heating chamber such as the air amount is previously found for each of various conditions is referenced for setting the adjustment time, so that the temperature measurement can be conducted after the expiration of the adjustment time responsive to the heating condition and temperature detection not affected by steam can be executed more reliably.

According to the present invention, there is provided a high-frequency heating apparatus comprising a high-frequency generation section for supplying a high frequency to a heating chamber for storing a heated material; a steam generation section for supplying steam to the heating chamber; an infrared sensor for detecting temperature in the heating chamber through a detection hole made in a wall of the heating chamber; and a control section for controlling based on a heating control method of high-frequency heating apparatus as described above.

In the high-frequency heating apparatus, the control section performs centralized control of the high-frequency generation section, the steam generation section, and the infrared sensor, whereby the heating control method can be realized. Thus, steam is supplied to the heating chamber, high-frequency heating is performed, and the infrared sensor can precisely detect the heating temperature of the heated material.

According to the present invention, there is provided a high-frequency heating apparatus comprising a high-frequency generation section for supplying a high frequency to a heating chamber for storing a heated material; a steam generation section for supplying steam to the heating chamber; a circulation fan for agitating air in the heating chamber; an infrared sensor for detecting temperature in the heating chamber through a detection hole made in a wall of the heating chamber; and a control section for controlling based on a heating control method of high-frequency heating apparatus as described above.

In the high-frequency heating apparatus, the control section performs centralized control of the high-frequency generation section, the steam generation section, the circulation fan, and the infrared sensor, whereby the heating control method can be realized. Thus, steam is supplied to the heating chamber, high-frequency heating is performed, and the infrared sensor can precisely detect the heating temperature of the heated material.

Preferably, the steam generation section is disposed at a position substantially out of the temperature detection range of the infrared sensor.

In the high-frequency heating apparatus, the steam generation section is disposed at a position out of the infrared detection range, whereby the temperature measurement of the heated material in the heating chamber is not hindered at all although the steam generation section reaching a high temperature is placed in the heating chamber.

BRIEF DESCRIPTION OF THE DRAWINGS

FIG. 10A is a drawing to show a state before the lid is put and FIG. 10B is a drawing to show a state in which the lid is put;

FIG. 35A shows the case where temperature unevenness exists and FIG. 35B shows the case where the heated material is heated uniformly;

FIG. 36 is a schematic representation to show a lookup table to select one table from the relationship between the volume of a heating chamber and the amount of water in an evaporation pan;

BEST MODE FOR CARRYING OUT THE INVENTION

Referring now to the accompanying drawings, there are shown preferred embodiments of a heating control method of a high-frequency heating apparatus and high-frequency heating apparatus according to the invention.

At first, the high-frequency heating apparatus will be described with reference to the drawings.

Figure 1:
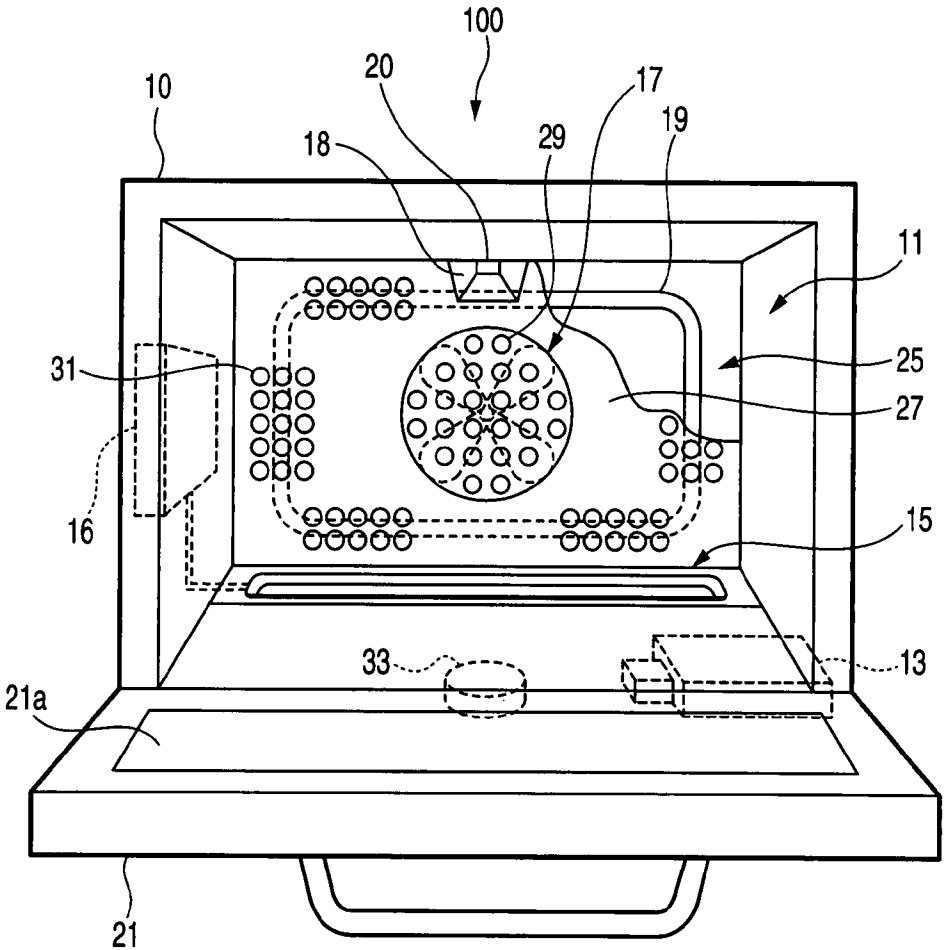
FIG. 1 is a front view to show a state in which a door of a high-frequency heating apparatus with steam generation function of a first embodiment of the invention is opened.
Figure 2:
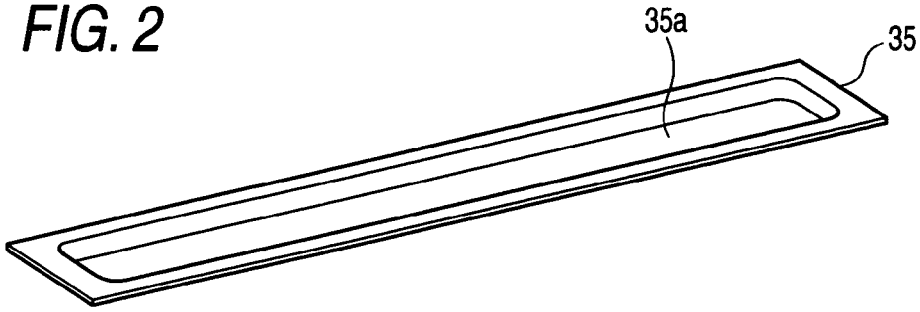
FIG. 2 is a perspective view to show an evaporation pan of a steam generation section used with the high-frequency heating apparatus with steam generation function in FIG. 1.
Figure 3:
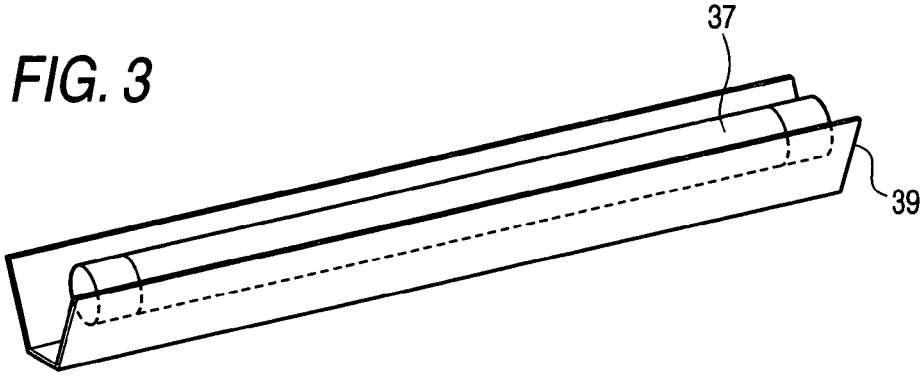
FIG. 3 is a perspective view to show an evaporation pan heater and a reflecting plate of the steam generation section.
Figure 4:
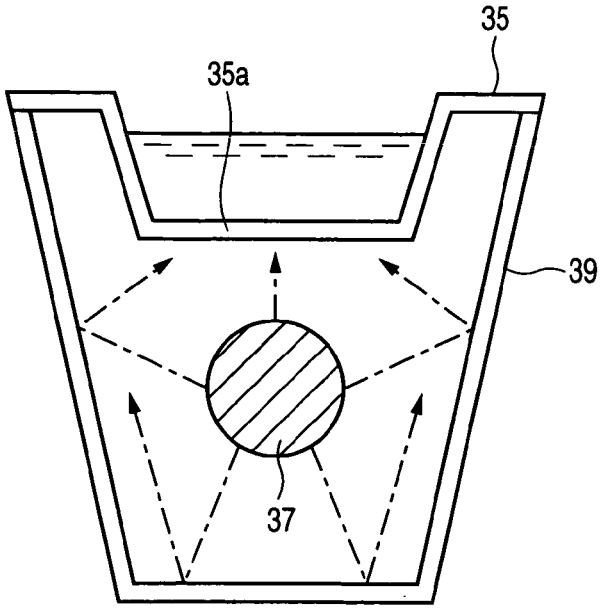
FIG. 4 is a sectional view of the steam generation section of the apparatus.

FIG. 1 is a front view to show a state in which a door of a high-frequency heating apparatus with steam generation function of the present invention is opened. FIG. 2 is a perspective view to show an evaporation pan of a steam generation section used with the apparatus. FIG. 3 is a perspective view to show an evaporation pan heater and a reflecting plate of the steam generation section. FIG. 4 is a sectional view of the steam generation section.

A high-frequency heating apparatus with steam generation function 100 is a cooking utensil for supplying at least either of a high frequency (microwave) and steam to a heating chamber 11 for storing a heated material and heat-treating the heated material. It includes a magnetron 13 as a high-frequency generation section for generation a high frequency, a steam generation section 15 for generating steam in the heating chamber 11, a circulation fan 17 for agitating and circulating air in the heating chamber 11, a convection heater 19 as a chamber air heater for heating air circulating in the heating chamber 11, and an infrared sensor 20 for detecting the temperature in the heating chamber 11 through a detection hole 18 made in a wall of the heating chamber 11.

The heating chamber 11 is formed in a main unit case 10 of a front-open box, and a door 21 with a light-transmitting window 21*a* for opening and closing a heated material outlet of the heating chamber 11 is provided at the front of the main unit case 10. The door 21 can be opened and closed as the lower end of the door 21 is hinged to the lower margin of the main unit case 10. A predetermined heat insulation space is provided between the walls of the heating chamber 11 and the main unit case 10 and is filled with a heat insulation material as required. Particularly, the space in the rear of the heating chamber 11 provides a circulation fan chamber 25 for housing the circulation fan 17 and a drive motor 23 of the circulation fan 17 (see FIG. 8), and the rear wall of the heating chamber 11 serves as a partition plate 27 for partitioning the heating chamber 11 and the circulation fan chamber 25. The partition plate 27 is formed with an area of ventilating holes for air suction 29 for sucking air from the heating chamber 11 to the circulation fan chamber 25 and an area of ventilating holes for blast 31 for sending air from the circulation fan chamber 25 to the heating chamber 11. The ventilating holes 29 and 31 are formed as a large number of punched holes.

The circulation fan 17 is placed with the rotation center positioned at the center of the rectangular partition plate 27 and the circulation fan chamber 25 contains the rectangular annular convection heater 19 placed so as to surround the circulation fan 17. The ventilating holes for air suction 29 made in the partition plate 27 are placed at the front of the circulation fan 17 and the ventilating holes for blast 31 are placed along the rectangular annular convection heater 19. As the circulation fan 17 is turned, air flows from the front of the circulation fan 17 to the rear side where the drive motor 23 exists, air in the heating chamber 11 is sucked into the center of the circulation fan 17 through the ventilating holes for air suction 29, passes through the convection heater 19 in the circulation fan chamber 25, and is delivered through the ventilating holes for blast 31 to the heating chamber 11. Therefore, according this flow, the air in the heating chamber 11 is circulated via the circulation fan chamber 25 while it is agitated.

The magnetron 13 is placed in the lower space of the heating chamber 11, for example, and a stirrer blade 33 as a radio agitation section is placed at the position receiving a high frequency generated from the magnetron 13. The high frequency from the magnetron 13 is applied to the rotating stirrer blade 33, whereby it is supplied to the heating chamber 11 while the high frequency is agitated by the stirrer blade 33. The magnetron 13 and the stirrer blade 33 can be placed not only at the bottom of the heating chamber 11, but also on the top or side of the heating chamber 11.

For example, water is supplied to the steam generation section 15 from a water tank 16 placed in the main unit case 10. As shown in FIG. 2, the steam generation section 15 is made up of an evaporation pan 35 having a water pocket recess 35*a* for generating steam by heating, and as shown in FIGS. 3 and 4, an evaporation pan heater 37 for heating the evaporation pan 35 and a reflecting plate 39 shaped roughly like a letter U in cross section for reflecting the radiation heat of the heater toward the evaporation pan 35. The evaporation pan 35 is shaped like an elongated plate made of stainless steel, for example, and is disposed with the length direction along the partition plate 27 on the depth bottom opposite to the heated material outlet of the heating chamber 11. A glass pipe heater, a sheathed heater, a plate heater, or the like can be used as the evaporation pan heater 37. The steam generation section 15 is disposed at a position out of the temperature detection range of the infrared sensor 20 for preventing the steam generation section 15 from interfering with the infrared sensor 20 measuring the temperature of heated material M in the heating chamber 11 although the steam generation section 15 reaching a high temperature is placed in the heating chamber 11.

Figure 5:
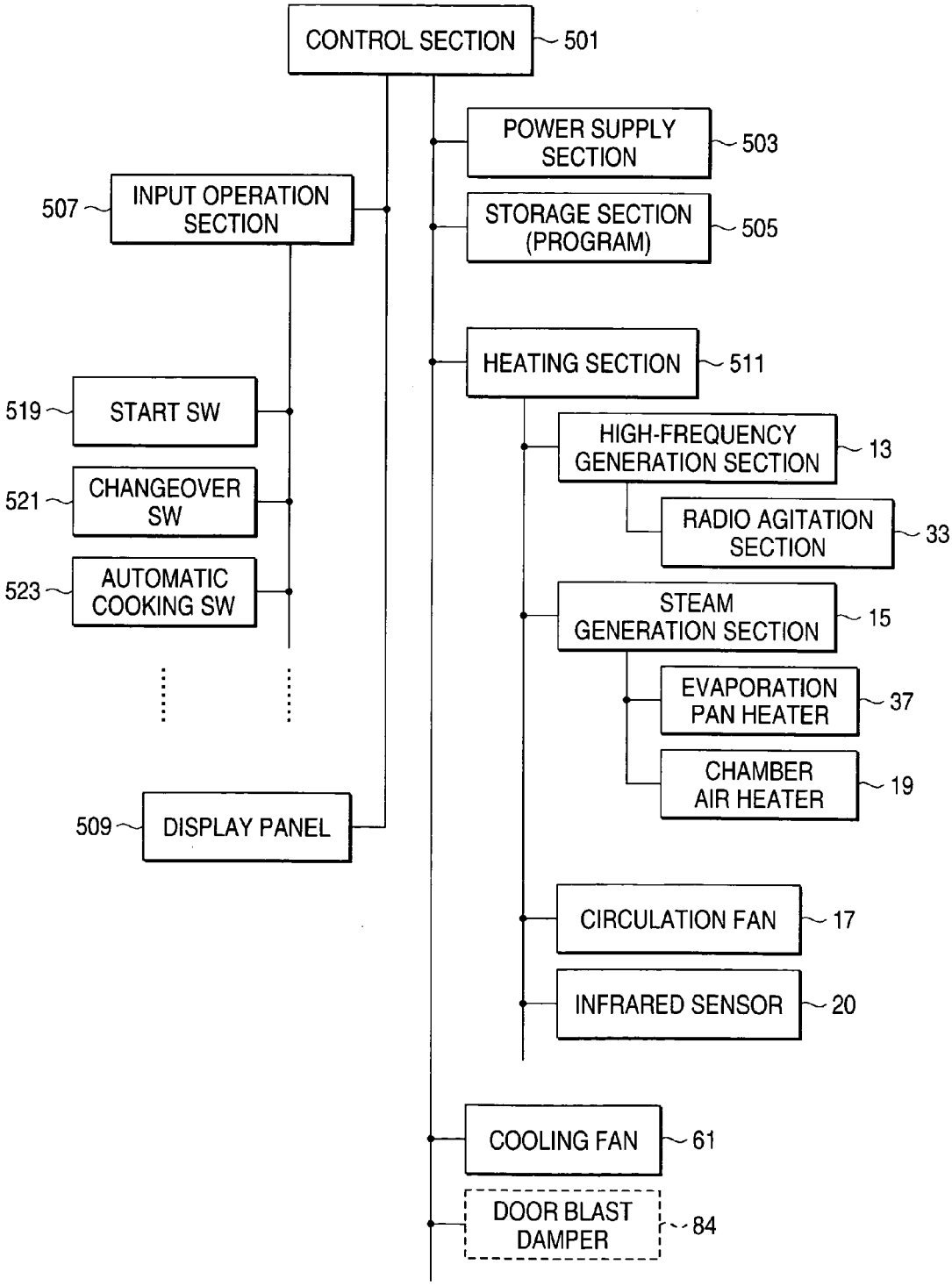
FIG. 5 is a block diagram of a control system for controlling the high-frequency heating apparatus with steam generation function.

FIG. 5 is a block diagram of a control system for controlling the high-frequency heating apparatus with steam generation function 100. The control system is formed centering on a control section 501 comprising a microprocessor, for example. The control section 501 transfers signals mainly to and from a power supply section 503, a storage section 505, an input operation section 507, a display panel 509, a heating section 511, a cooling fan 61, etc.

Connected to the input operation section 507 are various operation switches such as a start switch 519 for entering a heating start command, a changeover switch 521 for switching the heating method of high-frequency heating, steam heating, etc., and an automatic cooking switch 523 for starting a provided program.

The high-frequency generation section 13, the steam generation section 15, the circulation fan 17, the infrared sensor 20, and the like are connected to the heating section 511. The high-frequency generation section 13 operates in cooperation with the radio agitation section (drive section of stirrer blade) 33, and the evaporation pan heater 37, the chamber air heater (convention heater) 19, and the like are connected to the steam generation section 15.

EMBODIMENT 1

The high-frequency heating apparatus and control method thereof according the first embodiment will be described below.

Figure 6:
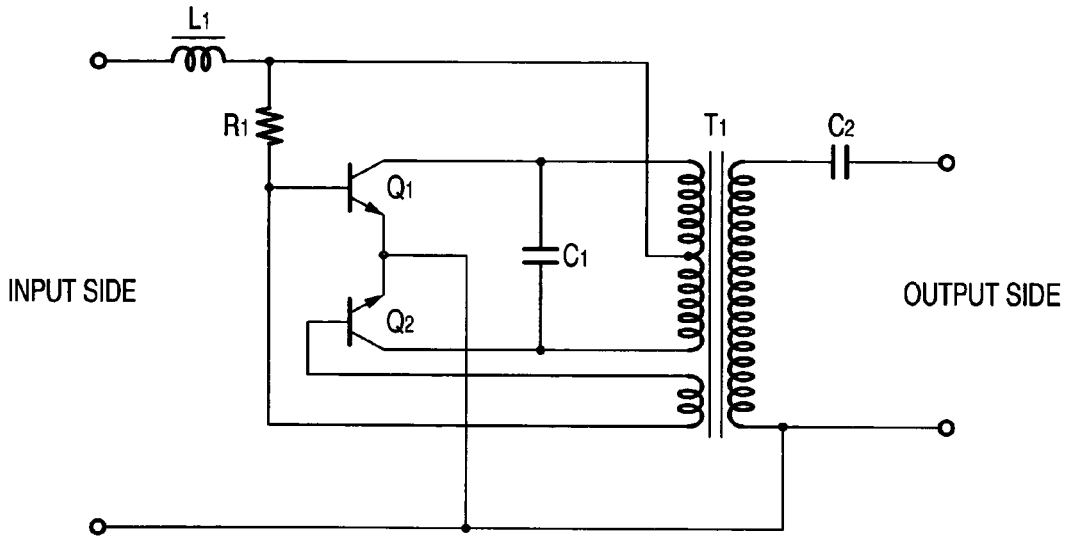
FIG. 6 is a circuit diagram or an inverter used with a power supply section of the apparatus.

FIG. 6 is a basic circuit diagram of an inverter used with the power supply section 503 (see FIG. 5) for performing variable control of heating electric power of the heating section 511 (see FIG. 5). The inverter is made up of transistors, an inductor, a transformer, capacitors, etc. In FIG. 6, when a voltage is applied to the input side, an electric current is supplied to transistors Q1 and Q2 through an inductor L1 and a resistor R1 and the transistors Q1 and Q2 repeat the on/off operation for oscillating. This oscillating becomes an oscillation waveform close to a sine wave as resonance mainly with a resonance capacitor C1 and a transformer T1. The transformer T1 raises the voltage supplied to the primary winding of the transformer to the voltage required for heating and outputs the voltage from the secondary winding. The high voltage generated by the transformer T1 is output through a ballast capacitor C2 to the output side. This circuit can appropriately increase or decrease the supply amount of electric power to the heating section 511.

Figure 7:
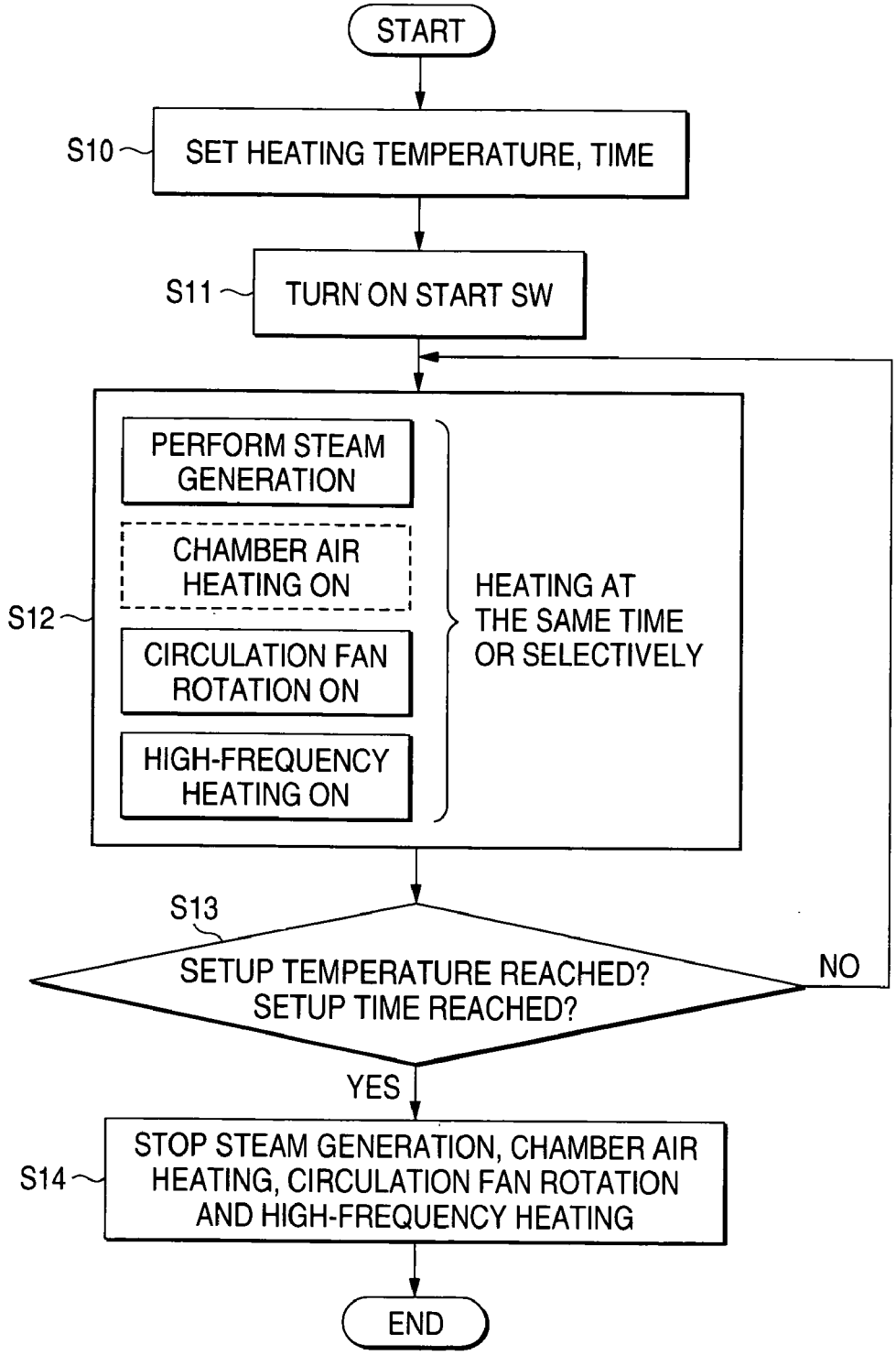
FIG. 7 is a flowchart to describe the basic operation of the high-frequency heating apparatus with steam generation function.

Next, the basic operation of the high-frequency heating apparatus with steam generation function 100 will be discussed with reference to a flowchart of FIG. 7.

As an operation sequence, first the food to be heated is placed on a plate, etc., and is entered in the heating chamber 11 and the door 21 is closed. The heating method, heating temperature, or time is set through the input operation section 507 (step 10 (S10)) and the start switch 519 is turned on (S11) Then, automatic heating treatment is performed under the control of the control section 501 (S12).

That is, the control section 501 reads the setup heating temperature or time, selects and executes the optimum cooking method based on the temperature or time, and determines whether or not the setup heating temperature or time is reached (S13). When the setup heating temperature or time is reached, the control section 501 stops each heating source and terminates the heating treatment (S14). At S12, steam generation, chamber air heating, circulation fan rotation, and high-frequency heating are performed separately or at the same time.

Figure 8:
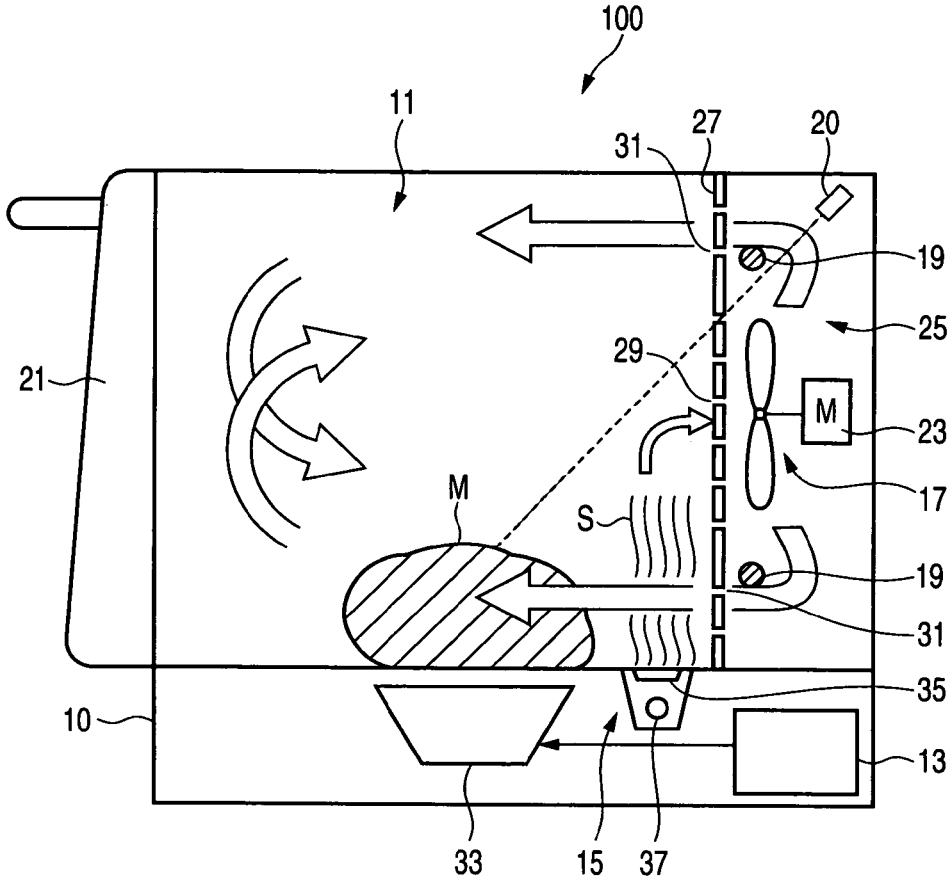
FIG. 8 is a schematic representation of the operation of the high-frequency heating apparatus with steam generation function.
Figure 9:
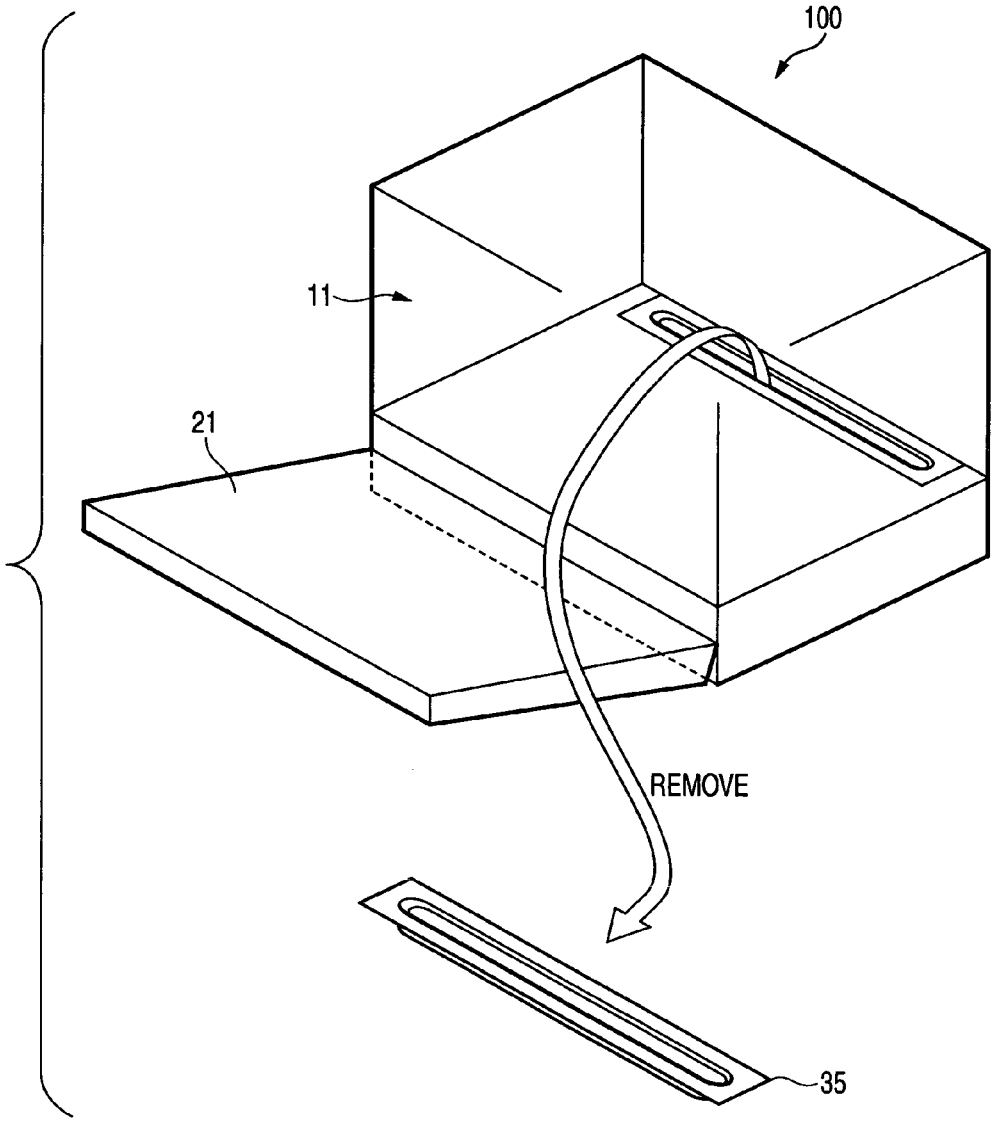
FIG. 9 is a schematic representation to show a state in which the evaporation pan is taken out to the outside of a heating chamber.

The function when a mode of "steam generation+circulation fan ON," for example, is selected and executed in the above-described operation will be discussed. When the mode is selected, as the evaporation pan heater 37 is turned on, water in the evaporation pan 35 is heated and steam S is generated as shown in FIG. 8 (schematic representation of the operation of the high-frequency heating apparatus 100). The steam S rising from the evaporation pan 35 is sucked through the ventilating holes for air suction 29 made roughly at the center of the partition plate 27 into the center of the circulation fan 17, passes through the circulation fan chamber 25, and is blown out through the ventilating holes for blast 31 made in the periphery of the partition plate 27 into the heating chamber 11. The blown-out steam S is agitated in the heating chamber 11 and is again sucked through the ventilating holes for air suction 29 roughly at the center of the partition plate 27 into the circulation fan chamber 25. Accordingly, a circulation path is formed in the heating chamber 11 and the circulation fan chamber 25. The ventilating holes for blast 31 are not made in the lower portion of the placement position of the circulation fan 17 of the partition plate 27 and the generated steam is guided into the ventilating holes for air suction 29. The steam circulates in the heating chamber 11 as indicated by hollow arrows in the figure, whereby the steam is blown on the heated material M.

At this time, as the chamber air heater 19 is turned on, the steam in the heating chamber 11 can be heated, so that the temperature of the steam circulating in the heating chamber 11 can be set to a high temperature. Therefore, so-called overheated steam can be provided and cooking of the heated material M with the surface getting burned is also made possible. To perform high-frequency heating, the magnetron 13 is turned on and the stirrer blade 33 is turned, whereby the high frequency is supplied to the heating chamber 11 while it is agitated, and even high-frequency heating cooking can be performed.

Thus, according to the high-frequency heating apparatus with steam generation function of the embodiment, the steam is generated inside rather than outside the heating chamber 11, so that the steam generation portion, namely, the evaporation pan 35 can be easily cleaned as the inside of the heating chamber 11 is cleaned. For example, calcium, magnesium, chlorine compound, and the like in water may be condensed and precipitated and adhere to the bottom of the evaporation pan 35 in the process of steam generation, but the deposits on the surface of the evaporation pan 35 can be simply wiped with a cloth, etc., for removal. Particularly, if the evaporation pan 35 is very dirty, the evaporation pan 35 can also be taken out to the outside of the heating chamber 11 for cleaning; the evaporation pan 35 can be easily cleaned. The evaporation pan 35 can also be easily replaced with a new evaporation pan 35 in some cases. Therefore, the heating chamber 11 including the evaporation pan 35 is made easy to clean and it becomes easy to always keep the inside of the heating chamber 11 in a hygienic environment.

In the high-frequency heating apparatus, the evaporation pan 35 is disposed on the depth bottom opposite to the heated material outlet of the heating chamber 11 and thus does not hinder taking out the heated material. If the evaporation pan 35 becomes at high temperature, there is no fear of touching the evaporation pan 35 when the heated material is taken in and out, and excellent safety is provided.

Further, in the high-frequency heating apparatus, the evaporation pan heater 37 heats the evaporation pan 35, thereby generating steam, so that steam can be efficiently supplied in the simple structure and steam at high temperature to some extent is generated by heating and thus it is also possible to cook with simply humidifying or cook while preventing drying using high-frequency heating in combination.

Since the radiation heat of the evaporation pan heater 37 is reflected on the reflecting plate 39 toward the evaporation pan 35, the heat generated by the evaporation pan heater 37 can be used to generate steam efficiently without waste.

In the high-frequency heating apparatus, the air in the heating chamber 11 is circulated and agitated by the circulation fan 17 and thus when steam heating is performed, steam can be spread uniformly to the corners of the heating chamber 11. Therefore, although the heating chamber 11 is filled with steam, the steam does not build up and is spread throughout the heating chamber 11. Consequently, when the infrared sensor 20 measures the temperature of the heated material, it reliably measures the temperature of the heated material rather than the temperature of the steam particles in the heating chamber 11, and the temperature measurement accuracy can be enhanced. Accordingly, the heating treatment based on the detected temperature can be properly performed without malfunction.

As the heating method, both of high-frequency heating and steam heating can be performed at the same time, either can be performed separately, and both can be performed in a predetermined order as desired, so that an appropriate heating method can be selected as desired in response to the food type, classification of frozen food, refrigerated food, etc. Particularly, to use high-frequency heating and steam heating in combination, temperature rise of the heated material can be speeded up, so that efficient cooking is made possible.

The air circulating in the heating chamber 11 can be heated by the chamber air heater 19 placed in the circulation fan chamber 25, so that the temperature of the steam generated in the heating chamber 11 can be adjusted as desired. For example, the temperature of the steam can also be set to a high temperature of 100° C. or more, so that the temperature of the heated material can be raised efficiently by overheated steam and the surface of the heated material can also be dried as the surface getting burned in some cases. If the heated material is frozen food, it can be thawed in a short time because the steam has a large heat capacity and heat transfer can be conducted efficiently.

Further, in the high-frequency heating apparatus with steam generation function 100, the circulation fan 17 is housed in the circulation fan chamber 25 provided separately through the partition plate 27 outside the heating chamber 11, so that gravy, etc., scattering during cooking of a heated material can be prevented from being deposited on the circulation fan 17. At the same time, ventilation is conducted through the ventilating holes 29 and 31 made in the partition plate 27, so that the steam flow occurring in the heating chamber 11 can be changed as desired according to the positions of the ventilating holes 29 and 31, the opening areas of the ventilating holes 29 and 31, etc.

Figure 10A:
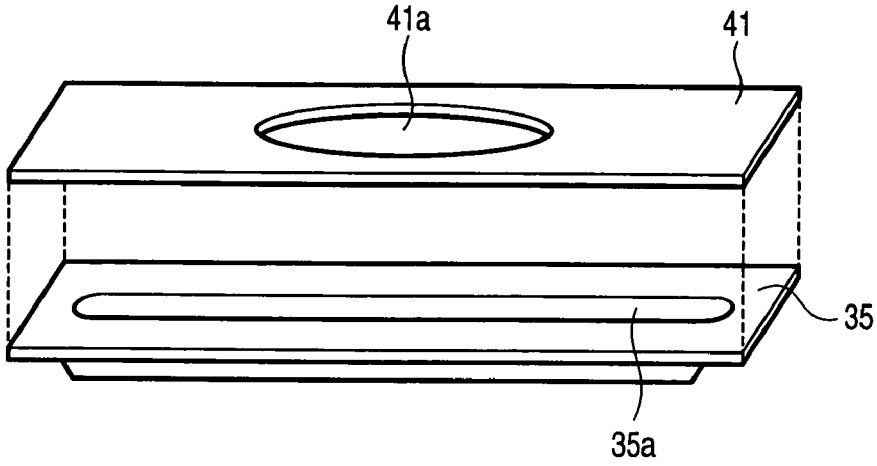
FIGS. 10A and 10B are perspective views of the evaporation pan and a lid used in the high-frequency heating apparatus with steam generation function.
Figure 10B:
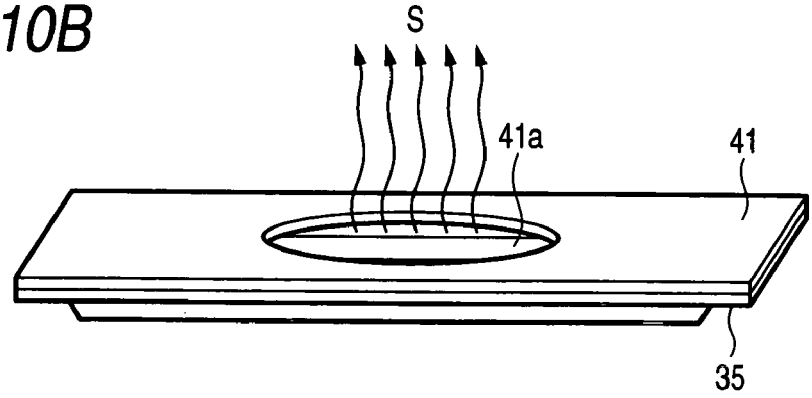

The top of the evaporation pan 35 is covered with a lid 41 formed in a part with an opening 41*a* as shown in FIG. 10A, whereby the vapor outgoing position can be limited to the portion of the opening 41*a* as shown in FIG. 10B. The steam supply amount can be adjusted in response to the opening area of the opening 41*a*.

Figure 11:
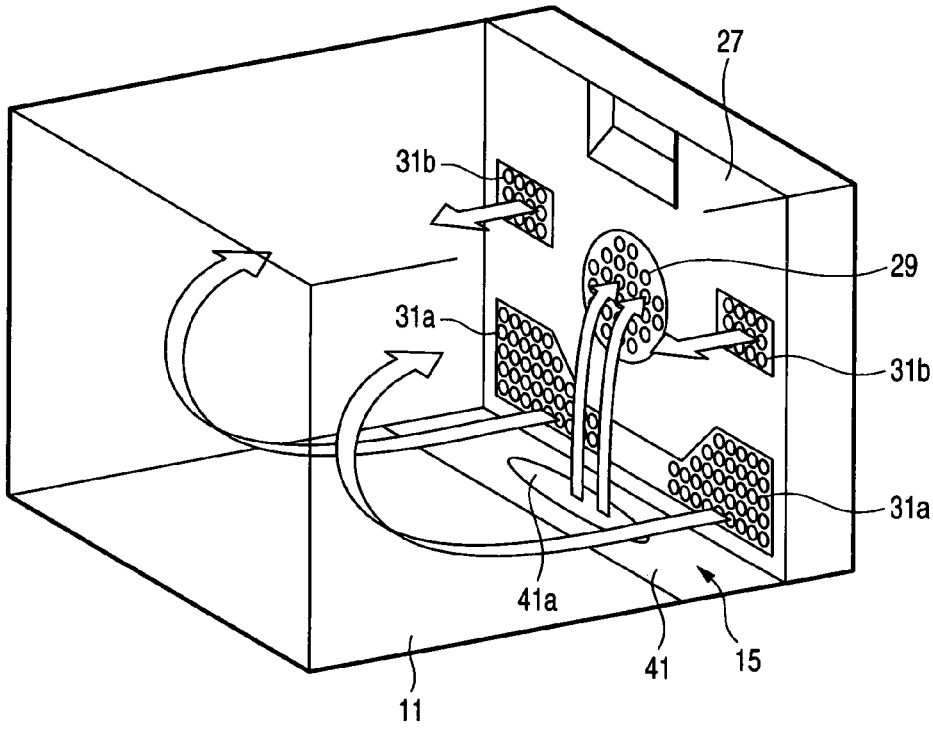
FIG. 11 is a schematic representation to show how steam circulates in the high-frequency heating apparatus with steam generation function.

The opening 41*a* is disposed below the ventilating holes for air suction 29 at the center of the partition plate 27 as shown in FIG. 11. Therefore, when generated steam rises through the opening 41*a*, immediately the steam is sucked into the ventilating holes for air suction 29 and circulates in the heating chamber 11 without wasteful escape as a circulation flow. The lid 41 is formed as a detachable lid, whereby it also becomes easy to replace the lid with another one with a different opening size and an appropriate lid responsive to the heating condition can be used.

As shown in FIG. 11, a large number of ventilating holes for blast 31*a* made in the partition plate 27 are formed in the lower portion of the partition plate 27 so that most of the steam sucked into the ventilating holes for air suction 29 can be mainly blown out from the proximity of the bottom of the heating chamber 11 to the inside of the heating chamber 11. Since the steam itself rises, if more steam is blown out from the lower side, the whole flow can be made uniform. In doing so, the steam in the heating chamber 11 first flows low in the vicinity of the bottom and then is directed upward. Ventilating holes for blast 31*b* are made in a roughly intermediate height portion of the partition plate 27; since the second-stage tray for placing a heated material (not shown) is placed at the roughly intermediate height position in the heating chamber 11, the ventilating holes for blast 31*b* are made for sending air to the heated material placed on the tray.

According to the configuration, a circulation flow for making more effective heating is generated and the temperature distribution in the heating chamber 11 is suppressed to a small temperature distribution. Therefore, the heated material placed in the heating chamber 11 can be heated uniformly and at high speed.

Next, the control method of the high-frequency heating apparatus with steam generation function having the configuration described above will be discussed in detail.

Figure 12:
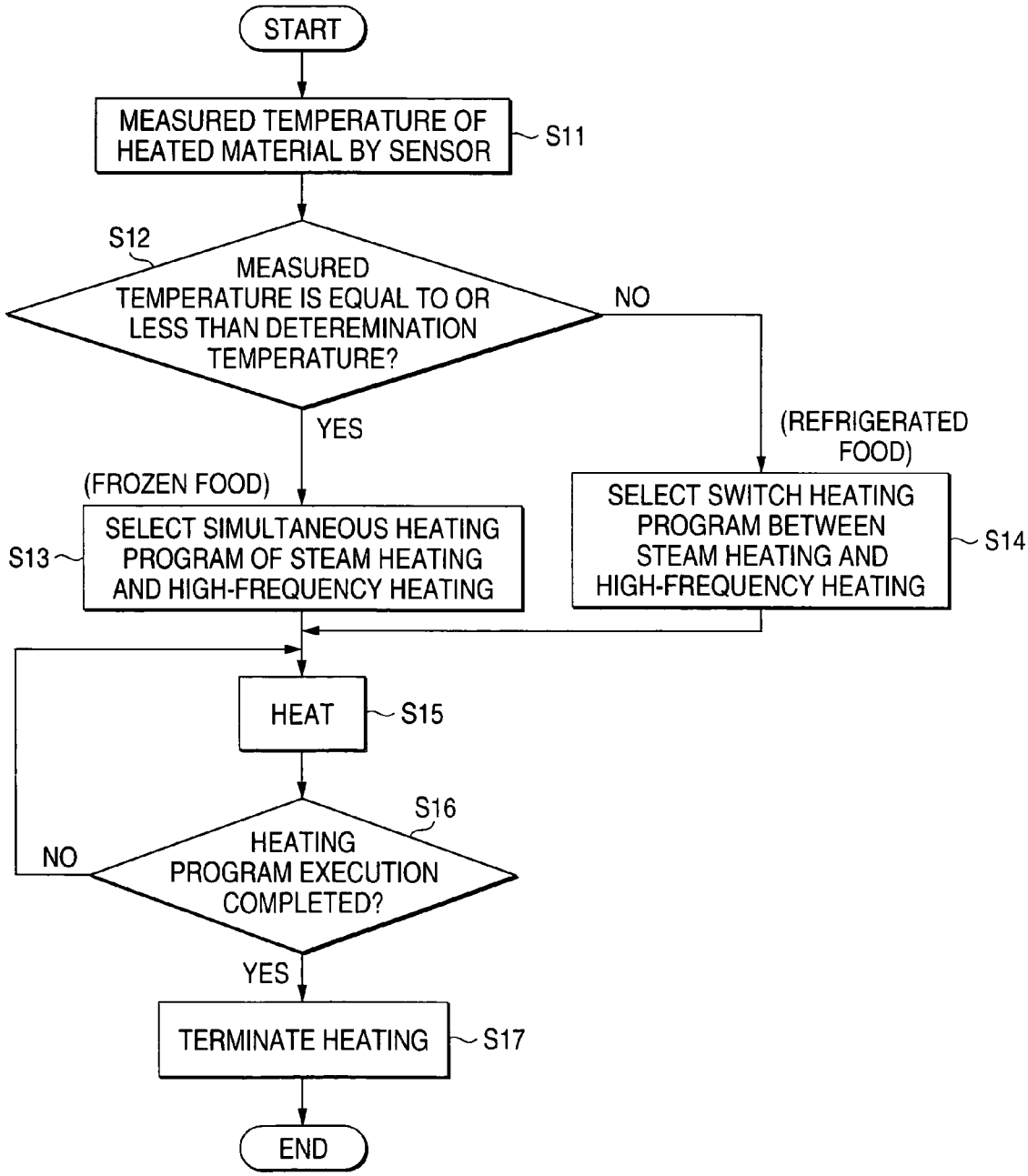
FIG. 12 is a flowchart to show a procedure of selecting a heating program and heating a heated material in response to the type of heated material.

FIG. 12 is a flowchart to show a procedure of selecting a heating program and heating a heated material in response to the type of heated material. In the control method, separate heating methods are adopted for frozen food and refrigerated food. Generally, the high frequency generated from a magnetron has the nature that it is absorbed in water molecules and is hard to penetrate into ice. On the other hand, the frozen food has a high percentage of containing ice and steam heating is more effective than high-frequency heating particularly at least until ice thaws. As steam heating is performed, steam is deposited on the surface of the heated material for transferring the heat quantity of the steam to the heated material, and temperature rise of the heated material can be speeded up by latent heat when the steam condenses on the surface of the heated material.

As the control procedure, first the infrared sensor 20 measures the temperature of the heated material stored in the heating chamber 11 (step 11 (S11). The measured temperature of the heated material is once stored in the storage section 505 (see FIG. 5). Determination temperature to determine whether the heated material is frozen food or refrigerated food is previously stored in the storage section 505. The control section 501 compares the determination temperature with the measured temperature of the heated material and determines whether the heated material is frozen food or refrigerated food (S12).

If the heated material is frozen food, a simultaneous heating program of steam heating and high-frequency heating is selected (S13); if the heated material is not frozen food, a switch heating program between steam heating and high-frequency heating is selected (S14). The heated material is heated according to the selected heating program (S15). Upon completion of the heating program (S16), the heating is terminated (S17). The heating programs are provided in the storage section 505.

Figure 13A:
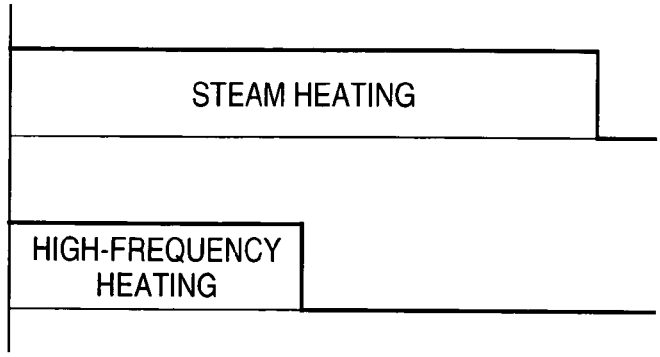
FIG. 13A is a heating timing chart of a simultaneous heating program and FIG. 13B is a heating timing chart of a switch heating program.
Figure 13B:
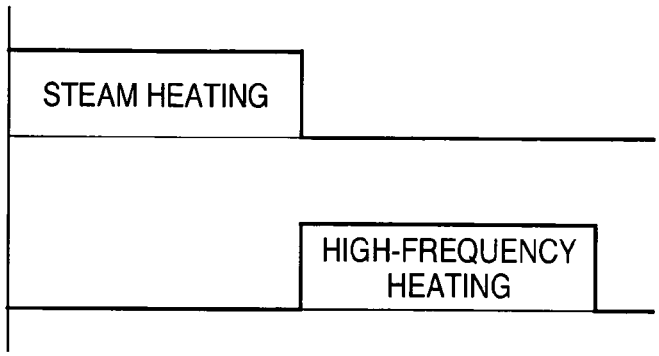

FIG. 13A is a heating timing chart of the simultaneous heating program and FIG. 13B is a heating timing chart of the switch heating program.

In the simultaneous heating program for heating frozen food in FIG. 13A, steam heating and high-frequency heating are performed at the same time for an initial predetermined time period and after the expiration of the predetermined time period, the high-frequency heating is stopped and the steam heating is executed.

In the switch heating program for heating refrigerated food in FIG. 13B, steam heating is performed for an initial predetermined time period and after the expiration of the predetermined time period, the steam heating is stopped and is switched to high-frequency heating and the high-frequency heating is executed. As the predetermined time period for switching, the heating time or the heating temperature may be set.

Figure 14:
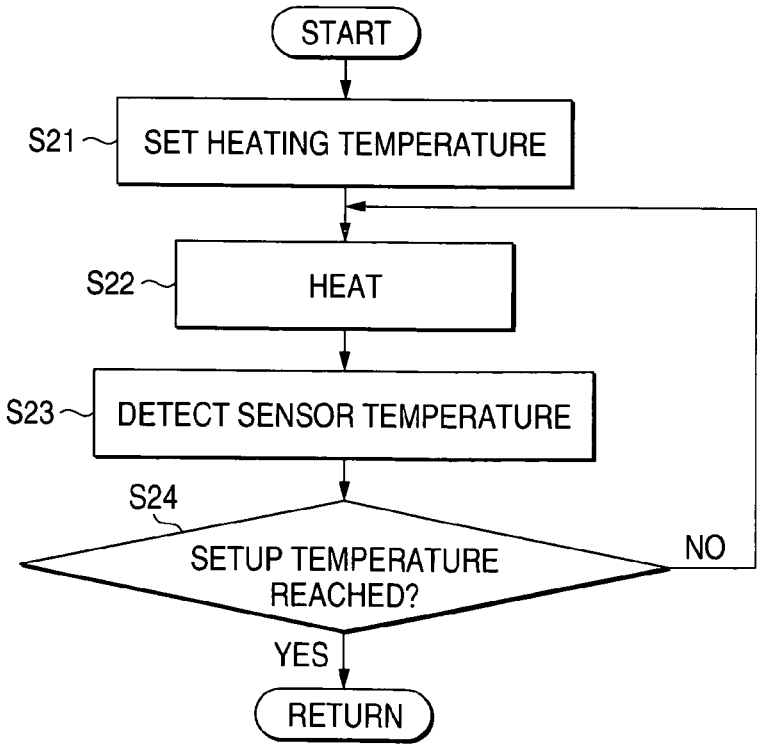
FIG. 14 is a flowchart to show a basic procedure for heating a heated material until the setup target heating temperature is reached.

FIG. 14 is a flowchart to show a basic procedure for heating a heated material until the setup target heating temperature is reached. In this flow, first the setup value of the heating temperature is read (S21) and heating is started (S22). During the heating, the infrared sensor 20 monitors the temperature of the heated material stored in the heating chamber 11 and when the measured temperature reaches the setup temperature, the heating is terminated (S23, S24).

Figure 15:
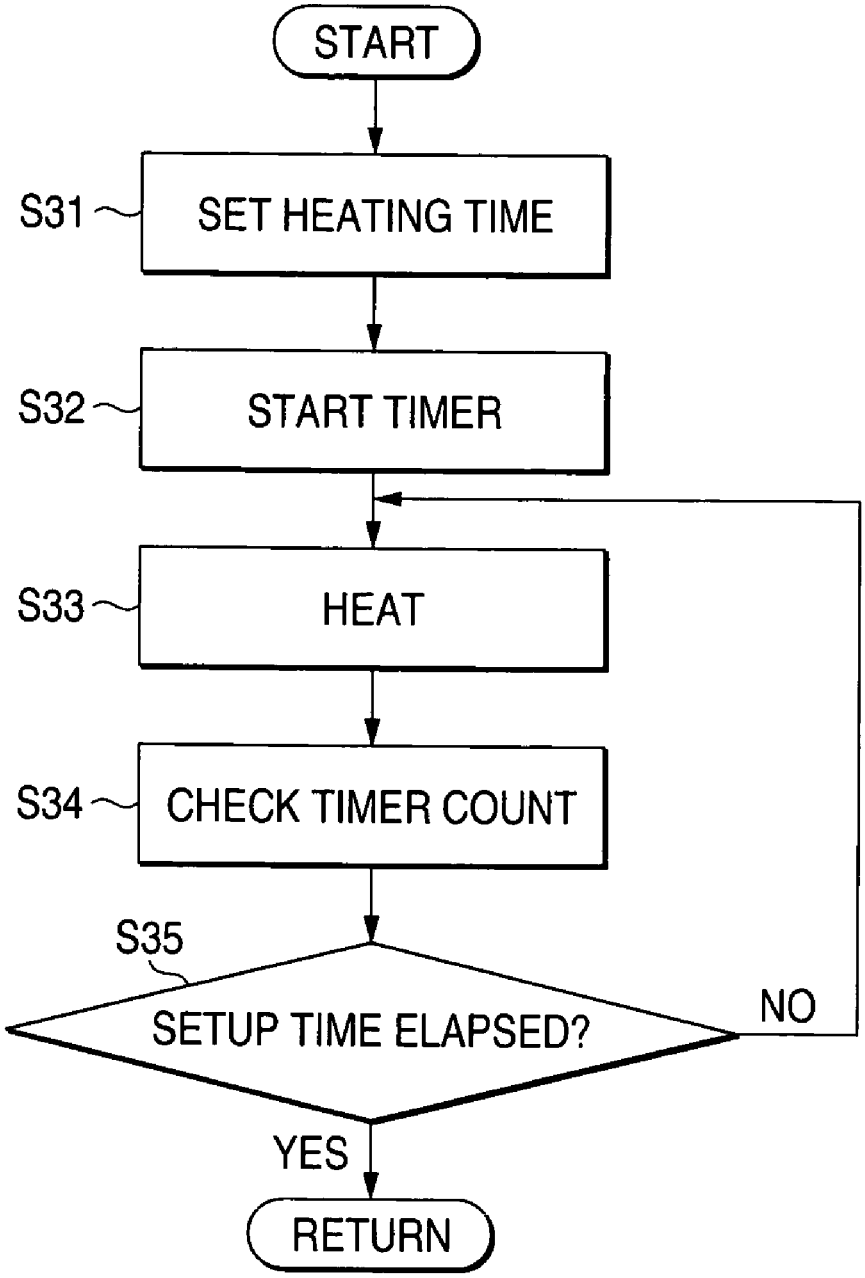
FIG. 15 is a flowchart to show a basic procedure for heating a heated material until the setup heating time is reached.

FIG. 15 is a flowchart to show a basic procedure for heating a heated material until the setup heating time is reached. In this flow, first the setup value of the heating time is read (S31) and a timer is started (S32) and then heating is started (S33). During the heating, the timer count is monitored and when the setup time has elapsed, the heating is terminated (S34, S35).

Next, heating patterns as steam generation, the circulation fan, the chamber air heater, and high-frequency heating are controlled will be discussed. The "steam heating" mentioned here means that the evaporation pan heater 37 and the circulation fan 17 are turned on (the chamber air heater (convection heater) 19 is turned on in some cases) and heating treatment is performed. The "high-frequency heating" means heating by applying a high frequency from the high-frequency generation section (magnetron) 13.

FIGS. 16 and 17 are drawings to show specific heating patterns and are timing charts of turning on/off steam generation, high-frequency heating, the circulation fan, and the chamber air heater.

Figures 16A, 16B, 16C, 16D:
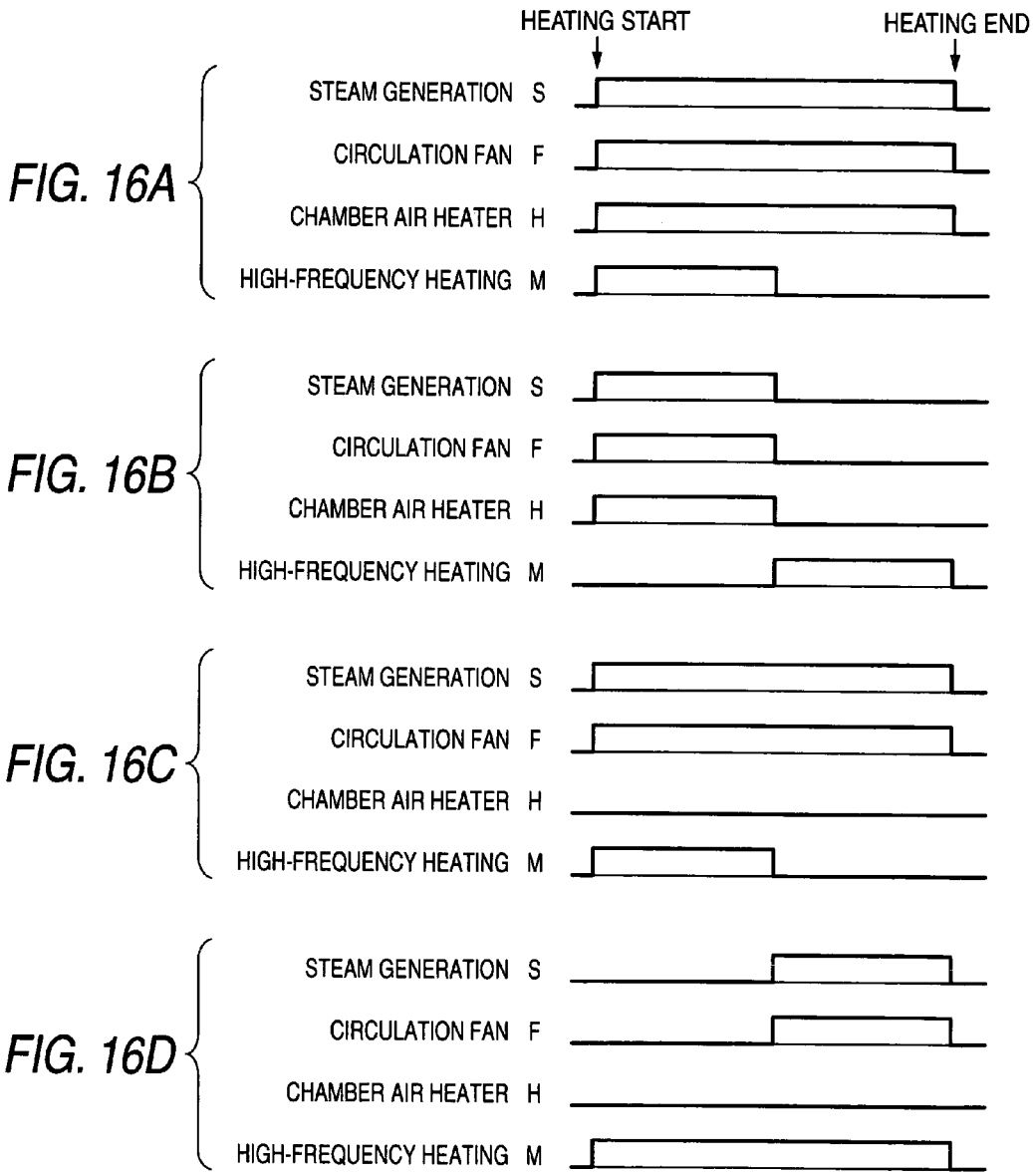
FIGS. 16A to 16D are drawings to show specific heating patterns.

In the heating pattern of FIG. 16A, steam generation, the circulation fan, and the chamber air heater are turned on from the heating start to the heating end and high-frequency heating is turned on in the first half and is turned off in the latter half. Accordingly, in the first half of the heating, generated steam circulates in the heating chamber while it is heated, and at the same time, as a high frequency is supplied, the heated material is quickly heated by the synergistic effect of the steam and the high frequency. In the latter half of the heating, the heated material is heated by the heated and circulating steam. The heating pattern is suitable particularly for heating frozen food. For example, to heat a Chinese bun with a filling according to the heating pattern, cooking can be performed in such a manner that the outside of the Chinese bun with a filling gets burned while wet moisture is kept in the Chinese bun with a filling. That is, it is made possible to trap moisture inside and moreover make only the surface portion get burned.

In the heating pattern of FIG. 16B, steam generation, the circulation fan, and the chamber air heater are turned on and high-frequency heating is turned off in the first half, and steam generation, the circulation fan, and the chamber air heater are turned off and high-frequency heating is turned on in the latter half. Accordingly, in the first half of the heating, generated steam circulates in the heating chamber while it is heated for heating particularly the surface of the heated material, and in the latter half of the heating, as a high frequency is supplied, the heated material is heated from the inside thereof. The heating pattern is suitable particularly for heating refrigerated food.

The heating pattern of FIG. 16C is a pattern wherein the chamber air heater in the heating pattern shown in FIG. 16A is turned off. If the heating pattern of FIG. 16C is executed, it is possible to heat the heated material so that sufficient moisture is contained in the heated material without heating generated steam by the chamber air heater.

The heating pattern of FIG. 16D is a pattern wherein high-frequency heating is performed throughout the first and latter halves and steam is supplied in the latter half. According to the heating pattern, it is made possible to heat the heated material in a state in which moisture prone to be lost by high-frequency heating is sufficiently contained in the heated material.

Figure 17A:
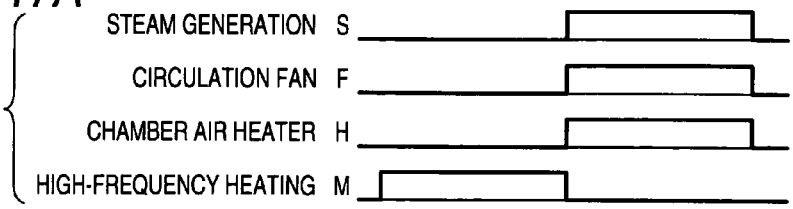
FIGS. 17A to 17E are drawings to show specific heating patterns.

The heating pattern of FIG. 17A is a pattern wherein turning on the chamber air heater in the latter half of the heating is added to the heating pattern of FIG. 16D. According to the heating pattern, the heated material can be heated while the heated material is replenished in the latter half of the heating with moisture lost from the heated material in the first half of the heating.

Figure 17B:
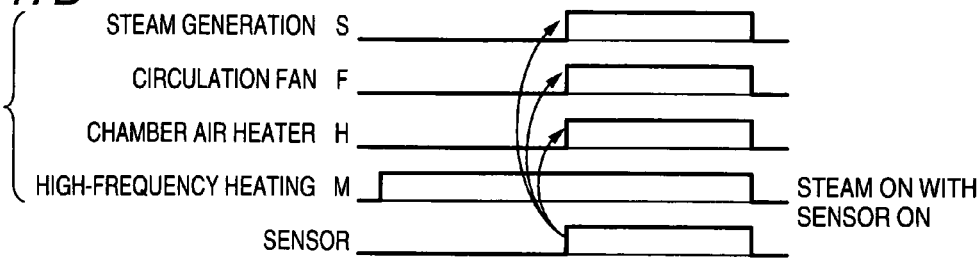

The heating pattern of FIG. 17B is a pattern wherein when the temperature sensor (infrared sensor) detects the heated material reaching a predetermined temperature or more as high-frequency heating is performed, steam heating is performed with the chamber air heater turned on. According to the heating pattern, the steam heating can be started at an appropriate timing responsive to the heating state independently of the heating time.

Figure 17C:
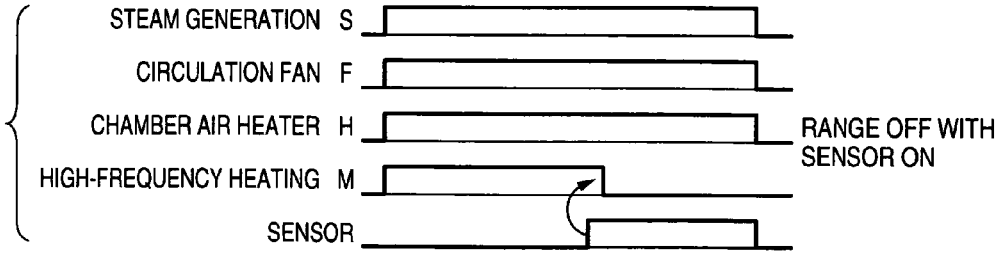

The heating pattern of FIG. 17C is a pattern wherein if steam heating and high-frequency heating are performed, when the temperature sensor detects the heated material reaching a predetermined temperature or more, the high-frequency heating is stopped and only the steam heating is performed. According to the heating pattern, excessively heating the heated material by the synergistic heating effect of the steam heating and the high-frequency heating can be prevented.

Figure 17D:
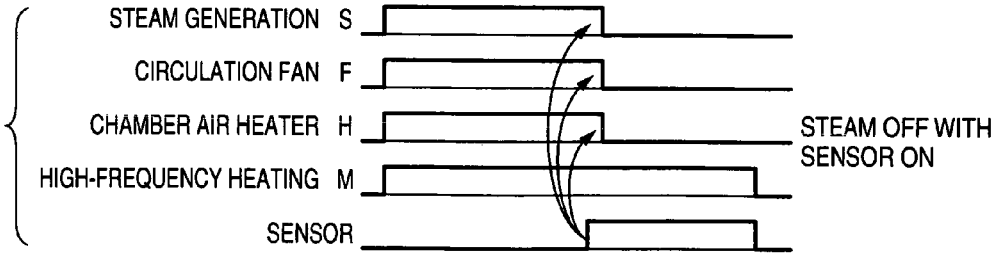

The heating pattern of FIG. 17D is a pattern wherein if steam heating and high-frequency heating are performed, when the temperature sensor detects the heated material reaching a predetermined temperature or more, the steam heating is stopped and only the high-frequency heating is continued. According to the heating pattern, excessively heating the heated material can be prevented as with the heating pattern of FIG. 17C.

Figure 17E:
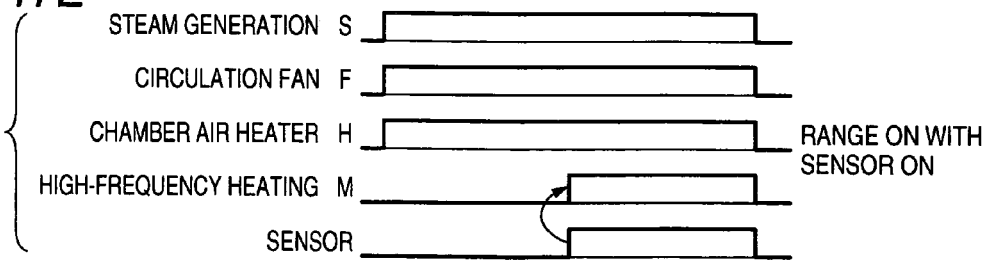

The heating pattern of FIG. 17E is a pattern wherein when steam heating is performed, at the stage at which the temperature sensor detects the heated material reaching a predetermined temperature or more, high-frequency heating is added and the steam heating and the high-frequency heating are performed at the same time. According to the heating pattern, for example, after the surface of the heated material is dried, the inside of the heated material in which moisture is trapped can be heated intensively.

The heating patterns have been described. When steam heating and high-frequency heating are performed at the same time in each heating pattern, they are executed mainly in combination with inverter control of an inverter. FIGS. 18A to 18D are timing charts to show types of combinations of heating power amounts required for high-frequency heating and steam heating.

Figure 18A:
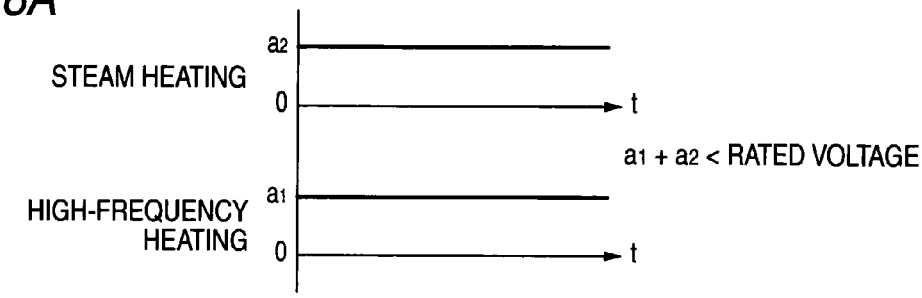
FIGS. 18A to 18D are timing charts to show types of combinations of heating power amounts required for high-frequency heating and steam heating.

In FIG. 18A, power amount a1 for high-frequency heating and power amount a2 for steam heating are set to constant values so that the sum (a1+a2) becomes smaller than rated power.

Figure 18B:
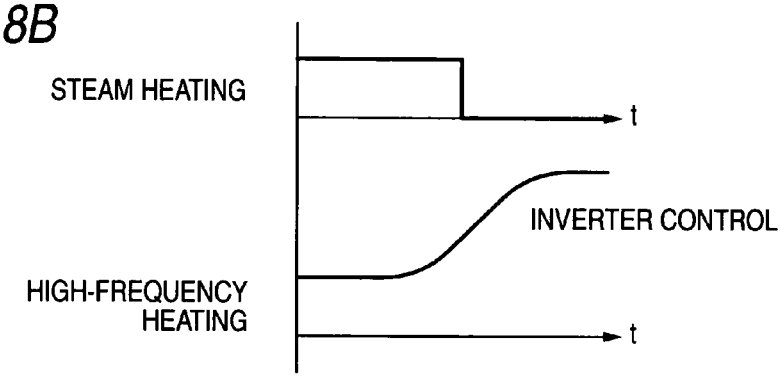

In FIG. 18B, high-frequency heating is controlled using the inverter and steam heating is performed in the first half and when the steam heating terminates, the high-frequency heating is strengthened gradually. According to the type, continuous change from the steam heating to the high-frequency heating is made in the latter half of the heating.

Figure 18C:
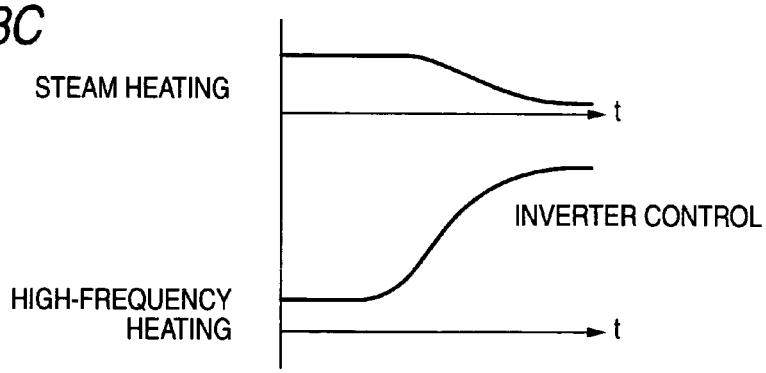

In FIG. 18C, in addition to high-frequency heating, steam heating is also controlled using the inverter and steam heating is performed mainly in the first half and the high-frequency heating is performed mainly in the latter half. In this case, smooth switching from the steam heating to the high-frequency heating is made possible and the heating amount can be prevented from lowering during the heating.

Figure 18D:
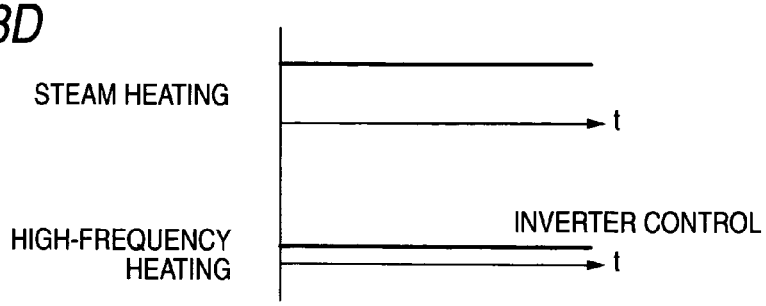

In FIG. 18D, while steam heating is performed, high-frequency heating is performed even faintly. According to the type, the inside of the heated material can be heated in addition to the heating effect of the heated material surface by steam heating.

In FIGS. 18B to 18D, the power amounts are also controlled so that the sum of the power amount required for steam heating and the power amount required for high-frequency heating becomes smaller than the rated power.

Next, a method of keeping the steam temperature at a preset constant temperature will be discussed.

Figure 19A:
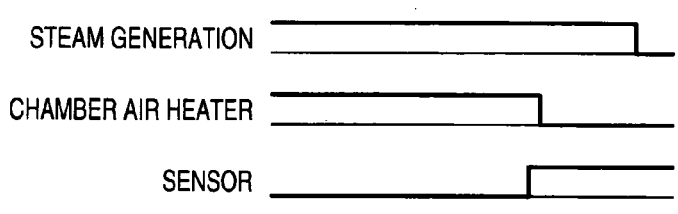
FIGS. 19A and 19B are schematic representations of a method of keeping the steam temperature in the heating chamber constant.
Figure 19B:
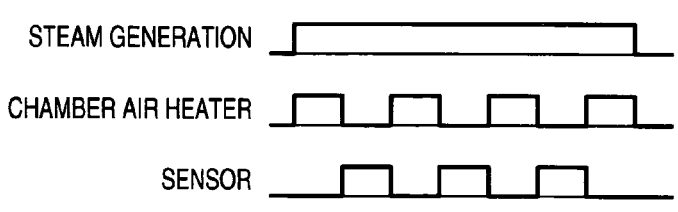
Figure 20:
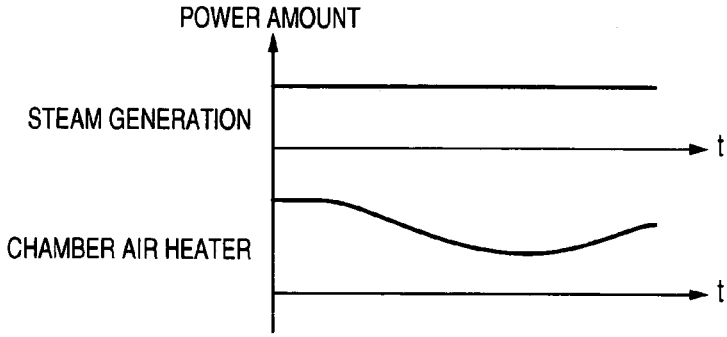
FIG. 20 is a timing chart of a method of adjusting so that the inside of the heating chamber always becomes a constant temperature by inverter control.

FIGS. 19A and 19B are schematic representations of the method of keeping the steam temperature in the heating chamber constant; FIG. 19A shows a method of heating by the chamber air heater (convection heater) 19 until the infrared sensor detects a predetermined temperature or more while steam is generated. FIG. 19B shows a method of controlling turning on and off the chamber air heater 19 in response to the output result of the temperature sensor. FIG. 20 shows a method of controlling the power amount of the chamber air heater 19 by an inverter while steam is generated, thereby adjusting so that the inside of the heating chamber always becomes a constant temperature. Any method can be used for controlling.

Figure 21:
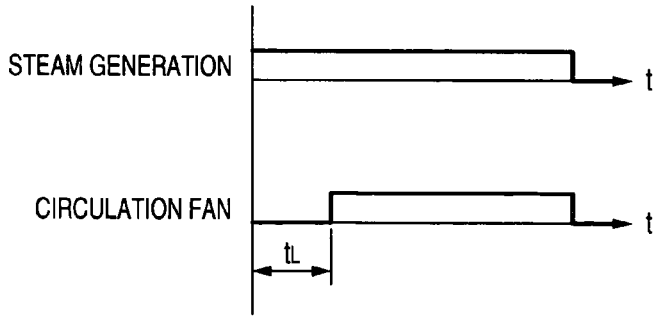
FIG. 21 is a timing chart of a method to prevent air in the heating chamber from being circulated until steam is generated.

When steam heating is performed, if a predetermined time is required until steam is actually generated, air in the heating chamber can also be prevented from being circulated until steam is generated. FIG. 21 is a time chart to show the contents. Assuming that the time period from the heating start, namely, the heating start of the evaporation pan heater 37 to the steam generation start is $T_L$, the circulation fan 17 remains as it stops for the time period $T_L$. In doing so, steam generation is promoted and the evaporation pan 35 can be prevented from being cooled wastefully by a circulation wind. Air sending of the circulation fan 17 may be set weak only for the predetermined time period $T_L$ by inverter control without completely stopping the circulation fan 17.

Next, a control method to remove fogging deposited on the door on the point of terminating the heating treatment will be discussed.

Figure 22:
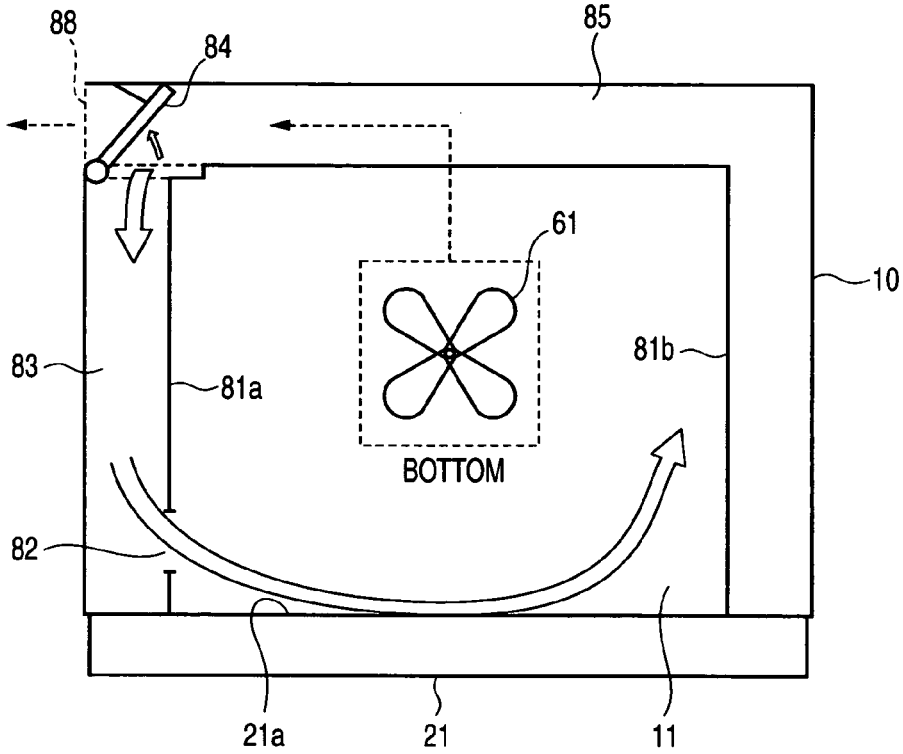
FIG. 22 is a plan view to show the mechanical configuration to control outside air blowing.
Figure 23:
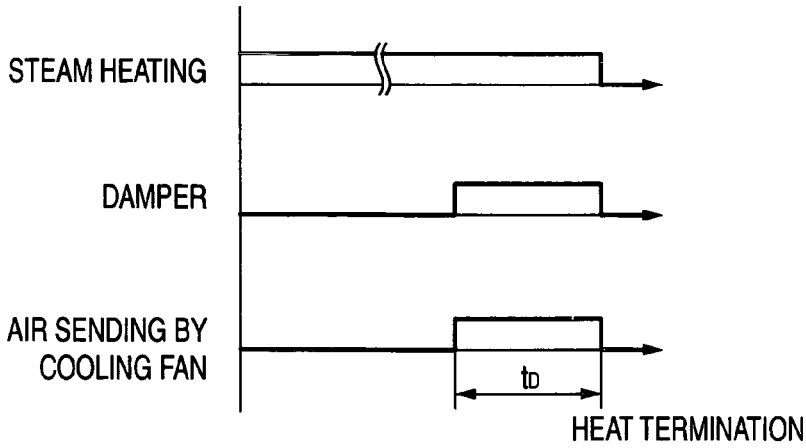
FIG. 23 is a time chart to show the control contents of outside air blowing.

To perform steam heating, steam may be deposited on the light-transmitting window 21*a* of the door 21 and the light-transmitting window 21*a* may get fogged, making it impossible for the cooker to peep into the heating chamber 11. In this case, the cooker cannot check the heating state in the heating chamber 11 and is insecure about it and this point is also undesired for safety. Then, according to the control method, outside air is introduced into the heating chamber for removing fogging. FIG. 22 is a plan view to show the mechanical configuration to perform the control. FIG. 23 is a time chart to show the control contents.

To blow outside air, air sending from the cooling fan 61 of the high-frequency generation section 13 placed at the bottom of the main unit case 10 as an example is used, as shown in FIG. 22. As the mechanical configuration, first an outside air outlet 82 for blowing outside air on the inner face of the light-transmitting window 21*a* of the door 21 is provided on a side wall 81*a* of the heating chamber 11 in the proximity of the door 21. The outside air outlet 82 is made to communicate with a side ventilation passage 83 provided between the main unit case 10 and the side wall of the heating chamber 11, and a rear ventilation passage 85 is connected via a damper 84 to the side ventilation passage 83. Air from the cooling fan 61 placed at the bottom of the apparatus can be blown into the heating chamber 11 from the outside air outlet 82 via the side ventilation passage 83 by switching the damper 84. If the damper 84 is switched to an opposite position, cooling air is exhausted through an exhaust port 88 to the outside.

In the control method, if the heating chamber 11 is filled with steam at the steam heating time or the high-frequency heating time, as shown in FIG. 23, air sent by the cooling fan 61 is introduced into the outside air outlet 82 by switching the damper 84 for a predetermined time period $t_D$ before the heating termination, and outside air is blown on the inner face of the light-transmitting window 21*a* of the door 21, whereby fogging on the light-transmitting window 21*a* can be removed.

As outside air is thus blown on the inner face of the light-transmitting window 21*a*, the light-transmitting window 21*a* can be prevented from getting fogged by steam at the steam heating time or the high-frequency heating time, and the heating state of the heated material in the heating chamber 11 can be visually checked from the outside. When the door is opened, a phenomenon in which the air of the front side is thick with steam can be suppressed. Since outside air is forcibly introduced and is blown on the light-transmitting window 21*a*, the expelling effect (cooling effect) of steam at the point in time before the door 21 is opened is particularly excellent.

Figure 24:
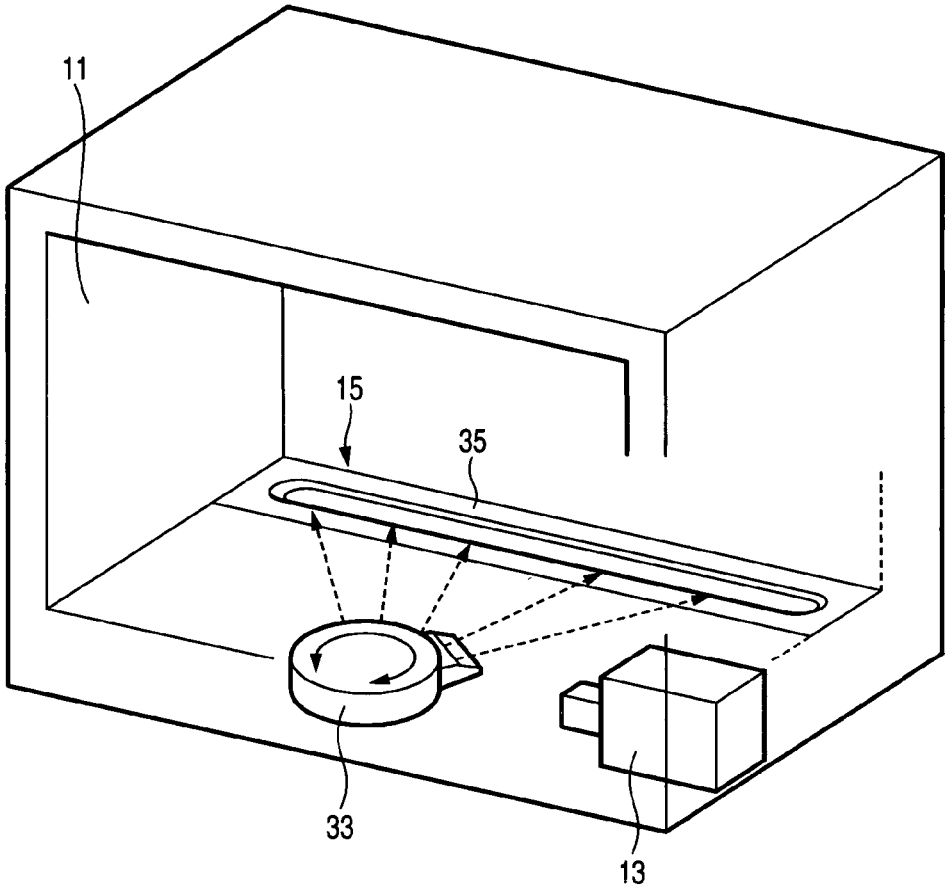
FIG. 24 is a schematic drawing of a high-frequency heating apparatus with steam generation function of the first embodiment of the invention.

In the embodiment, the case where the evaporation pan heater 37 is used to heat water in the evaporation pan 35 for generating steam is described. However, as shown in FIG. 24, water in the evaporation pan 35 can also be evaporated by high-frequency heating. In this case, water in the evaporation pan 35 may be high-frequency-heated by agitation of usual stirrer blade 33; preferably the emission destination of a high frequency by the stirrer blade 33 can be directed toward the evaporation pan 35 for intensively heating the evaporation pan 35. This can be accomplished by stopping the stirrer blade 33 at a specific position although the stirrer blade 33 usually rotates for uniformly heating the whole heating chamber 11. Therefore, if control is executed in such a manner that water in the evaporation pan 35 is heated intensively for a predetermined time and then return is made to usual heating, steam generation and high-frequency heating can be performed together.

Thus, if the evaporation pan heater is omitted and water in the evaporation pan 35 is heated and evaporated by applying a high frequency, the facility can be simplified and the cost can be reduced particularly as a dedicated heater to steam generation can be omitted.

In the embodiment, the example in which the stirrer blade 33 is placed for agitating a high frequency is described. However, the invention can also be applied to the configuration in which a turn table with a heated material placed thereon for rotation is used with the stirrer blade 33 omitted.

Figure 25A:
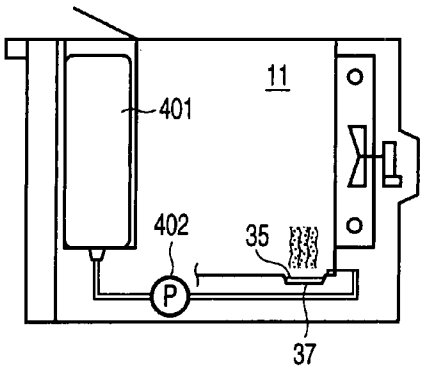
FIGS. 25A to 25E are schematic representations to show various variations of the steam generation section.

Next, variations of the steam generation technique of the steam generation section 15 will be discussed with reference to FIGS. 25A to 25E. In the figure, numeral 11 denotes a heating chamber, numeral 401 denotes a cartridge-type water tank, numeral 402 denotes a pump, and numeral 403 denotes a drainage mechanism. FIG. 25A shows the simplest type using the evaporation pan 35 and the evaporation pan heater 37 described above. When a far infrared heater of a glass pipe is used as the evaporation pan heater 37, steam can be generated in about 40 seconds with steam generation amount of about 10 g/minute. When a halogen heater is used, steam can be generated in about 25 seconds with the same level as the above-mentioned steam generation amount. The structure of this type has the advantages that it is simple and inexpensive and the time to steam generation is short.

Figure 25B:
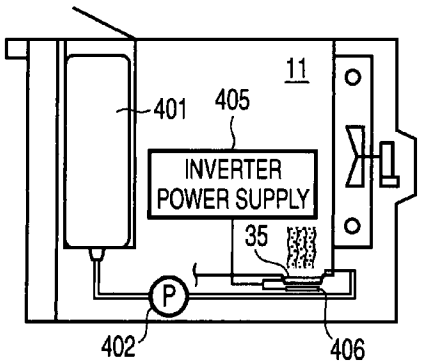

FIG. 25B shows the type wherein an inverter power supply 405 and an IH (Induction Heating) coil 406 are used to heat water in the evaporation pan 35. In this type, steam can be generated in about 15 seconds with steam generation amount of about 15 g/minute; the type has the advantage that the time to the generation is short.

Figure 25C:
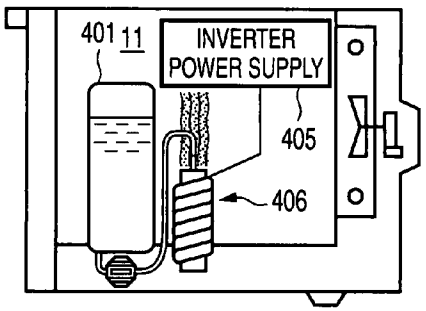

FIG. 25C shows the type using a drop IH steamer 406, wherein steam is generated by dropping a water drop on a member heated using an inverter power supply 405 and an IH (Induction Heating) coil. This type becomes upsized, but makes it possible to generate steam in about 5 seconds with steam generation amount of about 20 g/minute.

Figure 25D:
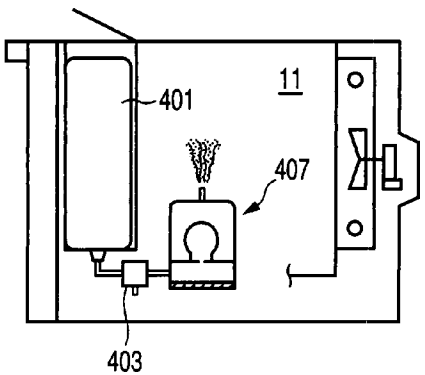

FIG. 25D shows the type wherein a boiler 407 is used to generate steam, wherein steam can be generated in about 40 seconds with steam generation amount of about 12 to 13 g/minute. This type can be formed at low cost although the drainage mechanism 403 and the like become complicated.

Figure 25E:
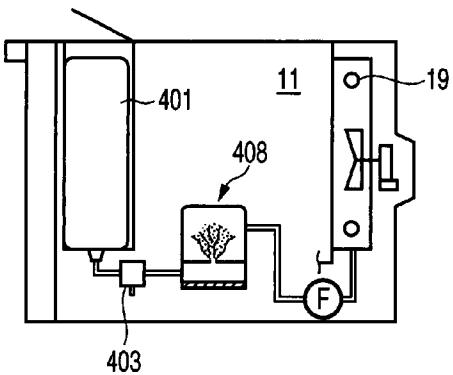

FIG. 25E shows the type using an ultrasonic steam generator 408, wherein generated steam is sucked out by a fan F and is heated by the chamber air heater 19 before the steam is supplied to the heating chamber 11.

Here, examples of various types of heating treatment conducted by the high-frequency heating apparatus with steam generation function according to the invention will be discussed.

Figure 26:
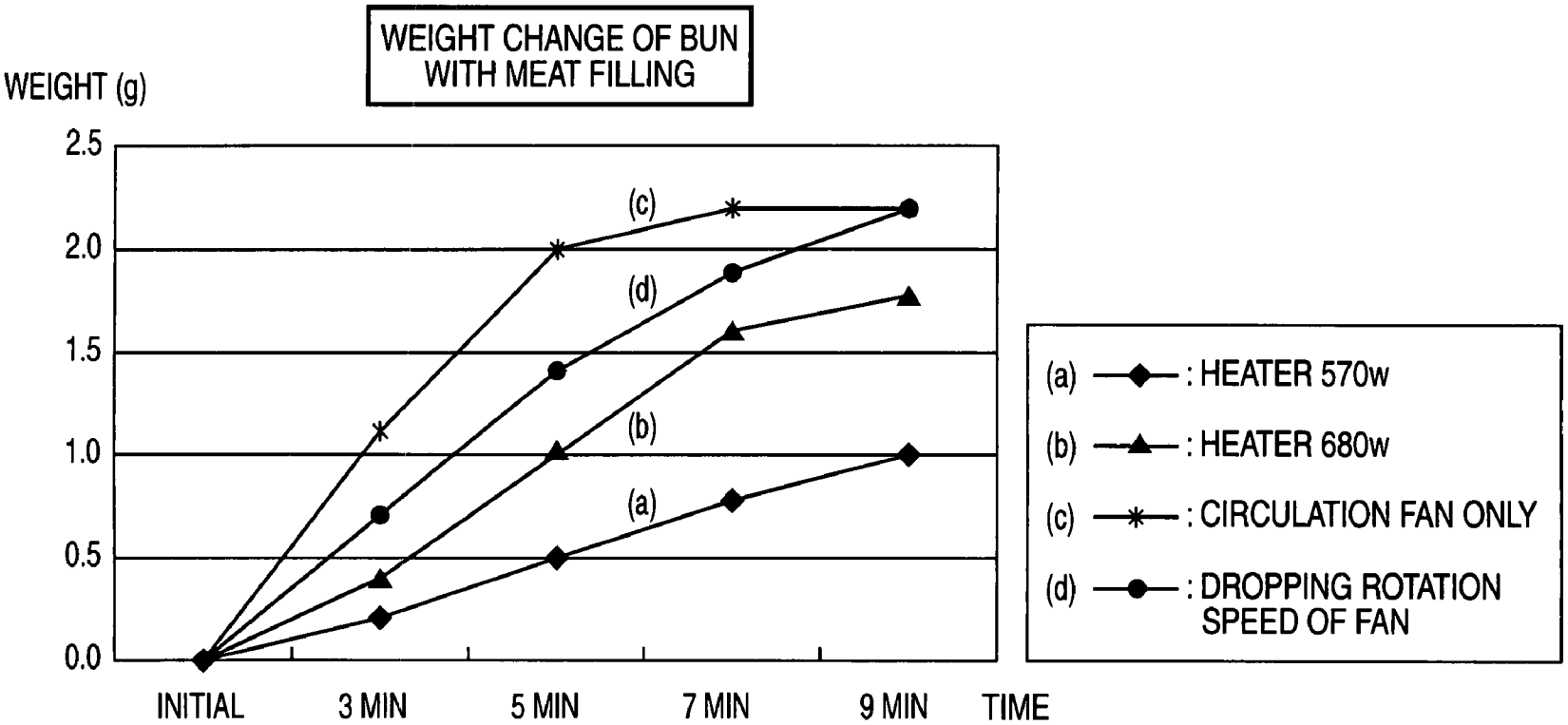
FIG. 26 is a drawing to show weight change made when one bun with a meat filling as a heated material is heated.

FIG. 26 shows weight change made when one bun with a meat filling as a heated material is heated. To heat (warm) the bun with a meat filling with steam, whether or not the bun can be finally heated to a good condition can be determined by an increase in moisture content.

(a) shows the case where steam heating was conducted by heating the convection heater as the chamber air heater with 570 W without operating the circulation fan. (b) shows the case where steam heating was conducted by heating the convection heater as the chamber air heater with 680 W without operating the circulation fan. In either case, it is seen that the moisture content increase relative to the heating time is comparatively small and the good warming effect with steam cannot be obtained simply by filling the heating chamber 11 with steam and heating the convection heater.

In contrast, if the circulation fan is operated as in (c), (d), comparatively high moisture content was able to be obtained and the good warming effect with steam was able to be obtained. It turned out that, as in (c), if the rotation speed of the circulation fan is dropped, the good warming effect with steam can be obtained with the passage of time. This means that as the circulation fan operates, the moisture content of the warmed article with steam can be enlarged. Therefore, to conduct steam heating, circulation of steam is indispensable.

Figure 27:
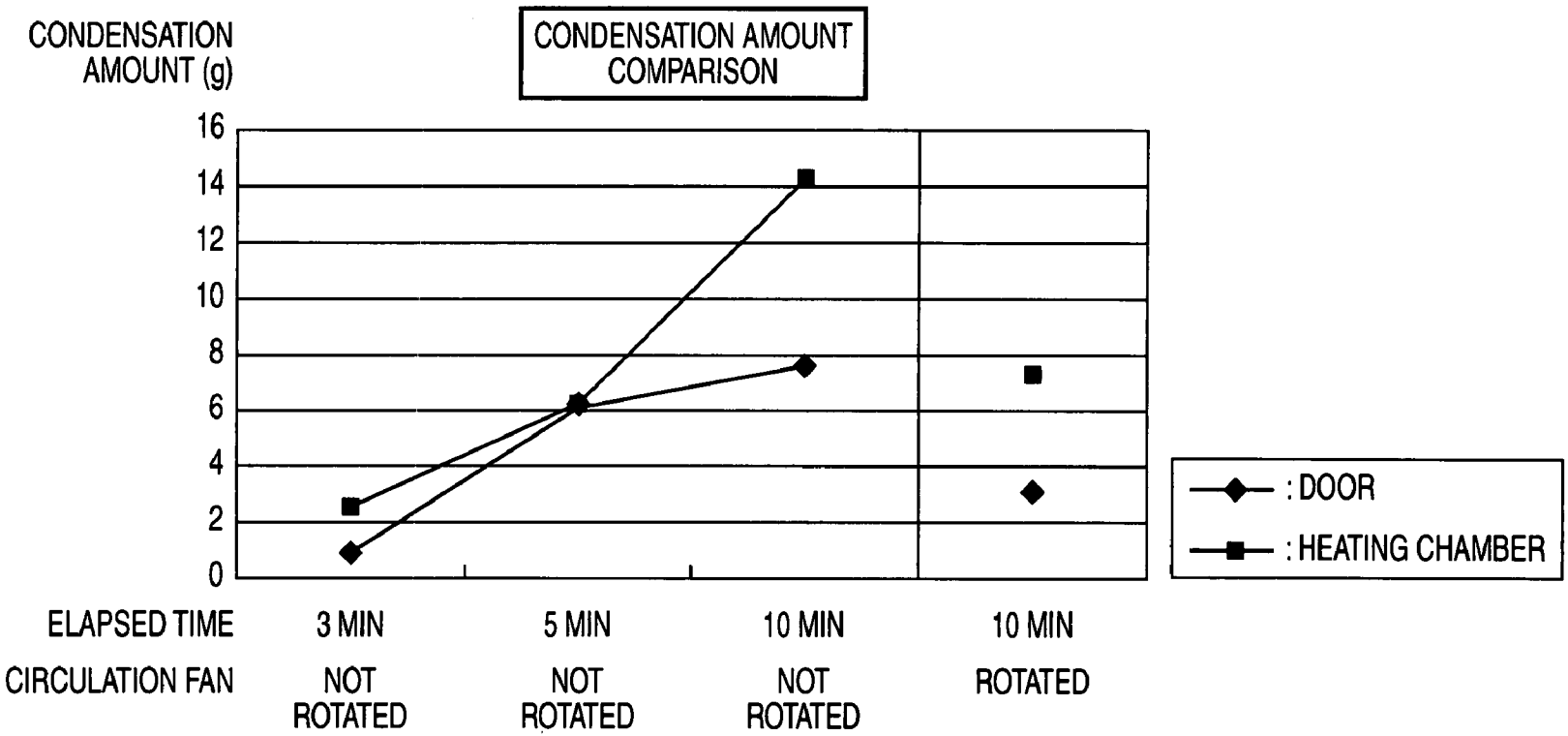
FIG. 27 is a drawing to show the difference between the condensation amounts on the door and in the heating chamber when the circulation fan is operated and those when the circulation fan is not operated.

FIG. 27 shows the difference between the condensation amounts on the door and in the heating chamber when the circulation fan is operated and those when the circulation fan is not operated. It is seen that although the condensation increases with the passage of time, the condensation amounts can be largely decreased as the circulation fan is operated. When the time of 10 minutes has elapsed since the heating start, 7.6 g on the door and 14.4 g in the heating chamber without rotation of the circulation fan are lowered to 3.1 g on the door and 7.3 g in the heating chamber with rotation of the circulation fan; the condensation amount can be reduced to about a half.

Figure 28:
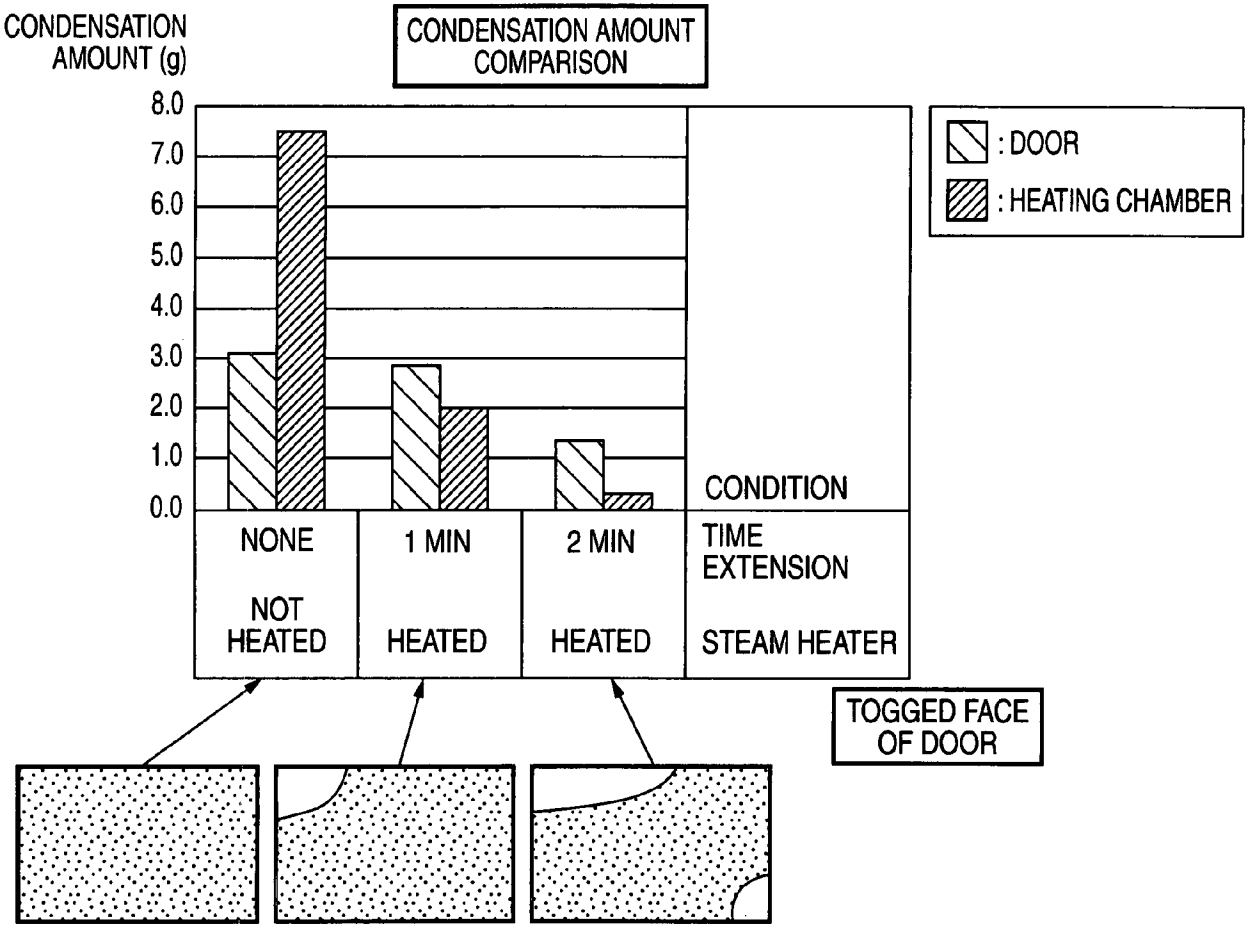
FIG. 28 is a drawing to show the examination result of change in the condensation amount in the chamber and on the door since the steam heating termination time with heating of the convection heater and without heating of the convection heater.

FIG. 28 shows the examination result of change in the condensation amount in the chamber and on the door since the steam heating termination time with heating of the convection heater and without heating of the convection heater. As the convection heater is operated, the condensation amount particularly in the heating chamber at the heating termination time, 7.3 g, is drastically lowered to 3.0 g (one minute) and 0.3 g (two minutes). As for the door, the tendency toward lowering from 3.1 g to 2.9 g (one minute) and 1.3 g (two minutes) is also observed.

Figure 29:
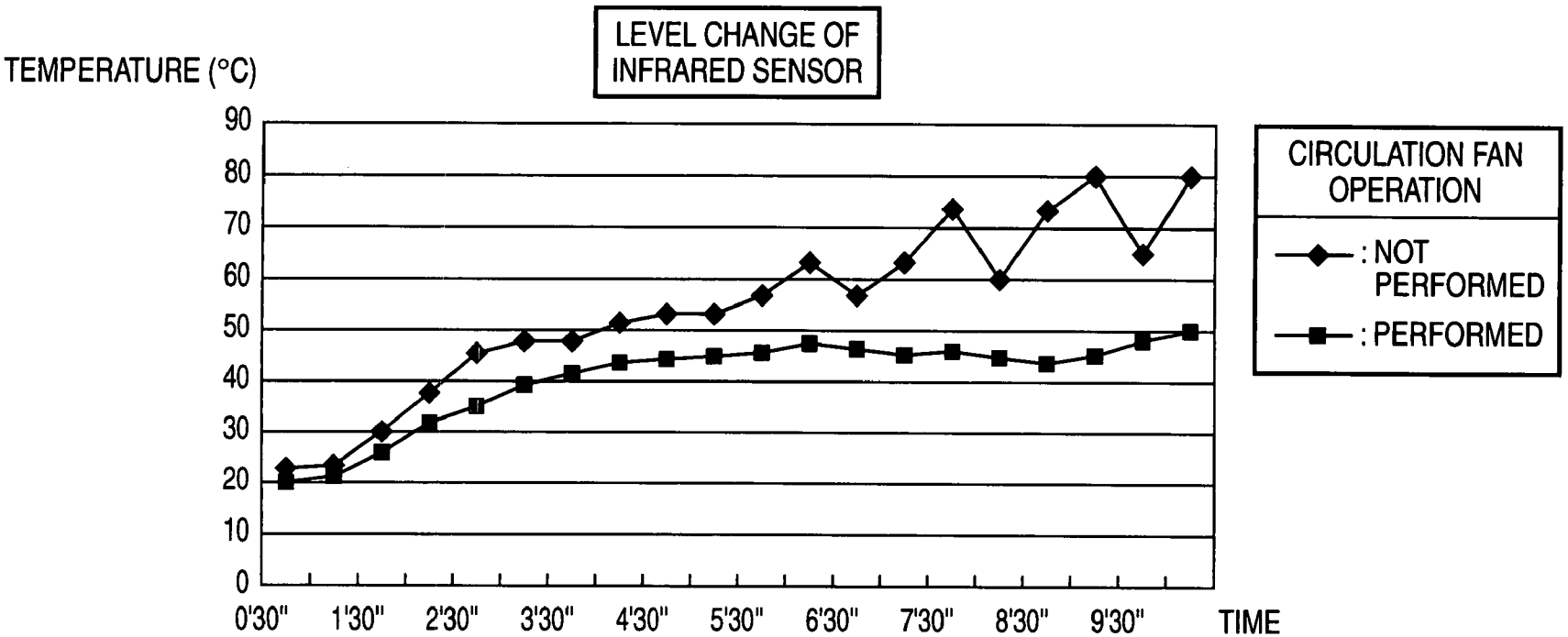
FIG. 29 is a drawing to show the examination result of the measurement performance of the infrared sensor with operation of the circulation fan and without operation of the circulation fan when the heating chamber is filled with steam.

FIG. 29 shows the examination result of the measurement performance of the infrared sensor with operation of the circulation fan and without operation of the circulation fan when the heating chamber is filled with steam. When the circulation fan is not operated, fluctuation occurs in the measurement value of the infrared sensor at a midpoint and the measurement accuracy is degraded; however, when the circulation fan is operated, stable measurement can always be conducted. This means that as the circulation fan is operated, the detection level of the infrared sensor is stabilized and good temperature measurement can be conducted.

EMBODIMENT 2

Next, a heating control method of the high-frequency heating apparatus of the second embodiment will be discussed with reference to the drawings.

Figure 30:
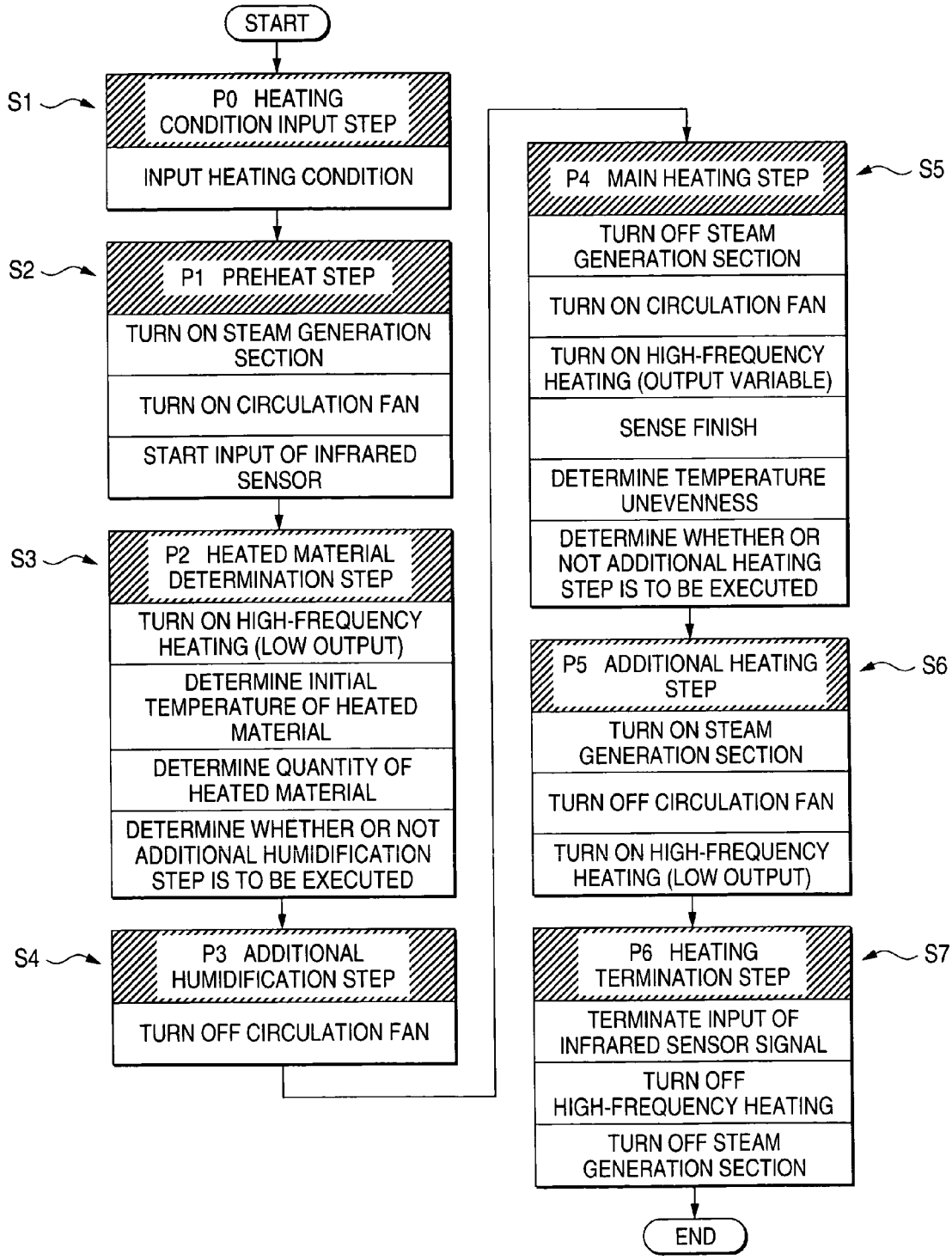
FIG. 30 is a flowchart of a heating control method of the high-frequency heating apparatus according to the invention.
Figure 31:
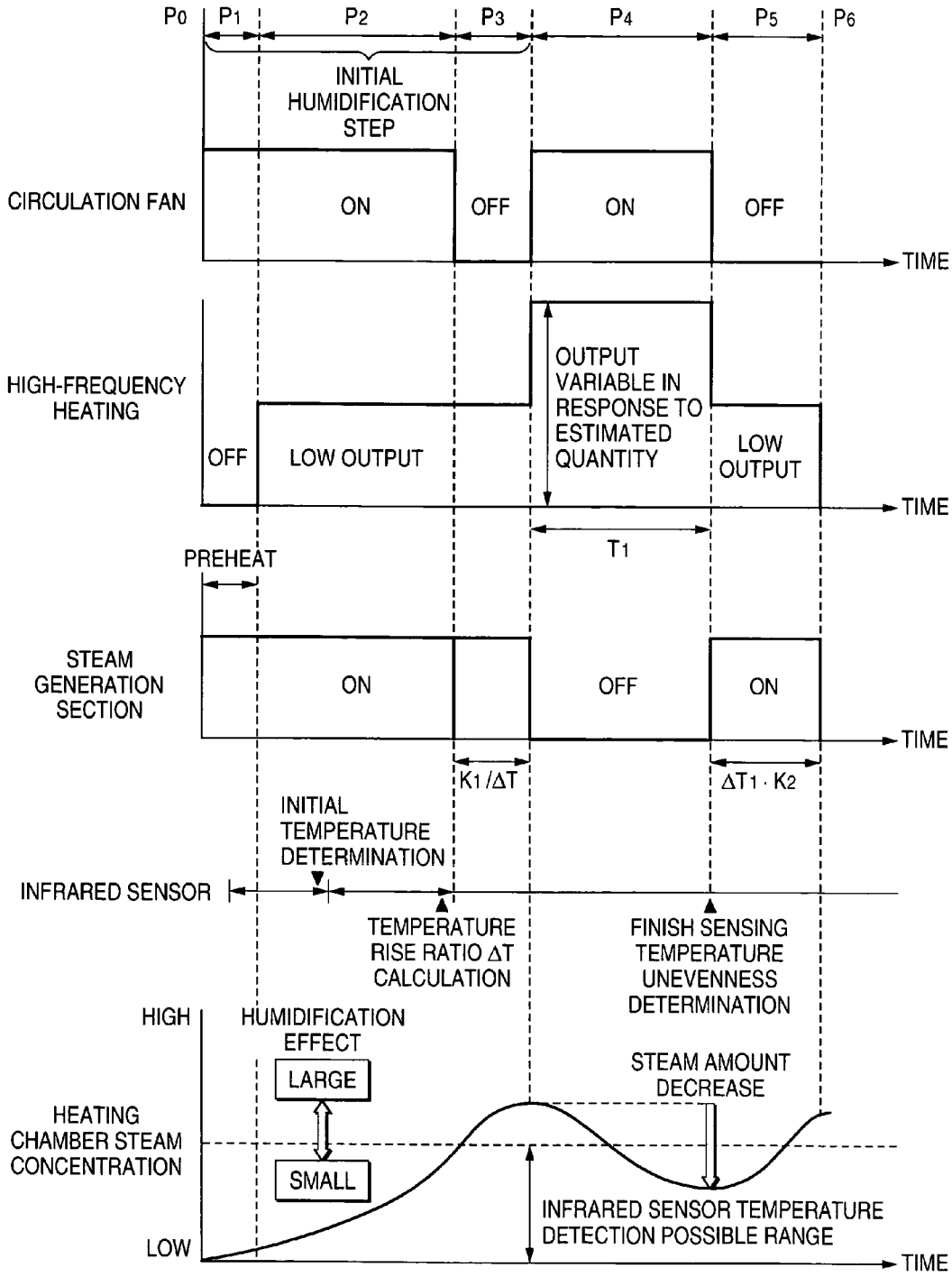
FIG. 31 is a time chart to show the control state of each part in the heating control method of the high-frequency heating apparatus according to the invention.

FIG. 30 is a flowchart of, FIG. 31 is a time chart, and FIG. 8 shows the internal state of the high-frequency heating apparatus.

As preprocessing before heating is started, in heating condition input step P0, first the user places a heated material M to be heated on a plate, etc., and enters the heating material M on the plate, etc., in the heating chamber 11 and closes the door 21. The user sets the heating condition through the input operation section 507 and turns on the start switch (step 1 (S1)). Here, the case where the user selects steam heating as the heating condition will be discussed.

When the start switch is turned on, first, preheat step P1 is started (S2). In the preheat step P1, the evaporation pan 35 is heated mainly by the evaporation pan heater 37 of the steam generation section 15 for making preparations for steam generation. The circulation fan 17 is turned on, high-frequency heating is turned off, and the steam generation section 15 is turned on under the control of the control section 501. The infrared sensor 20 is operated for measuring the temperature of the heated material M.

At the consecutive use time, etc., of the high-frequency heating apparatus 100, the time of the preheat step P1 can be shortened in response to the temperature of the evaporation pan 35.

Specifically, as the steam generation section 15 is turned on, the evaporation pan heater 37 is turned on for heating water in the evaporation pan 35, and steam S is generated in the heating chamber 11. As the circulation fan 17 is turned on, the steam S rising from the evaporation pan 35 is sucked through the ventilating holes for air suction 29 made roughly at the center of the partition plate 27 into the center of the circulation fan 17, passes through the circulation fan chamber 25, and is blown out through the ventilating holes for blast 31 made in the periphery of the partition plate 27 into the heating chamber 11. The blown-out steam S is agitated in the heating chamber 11 and is again sucked through the ventilating holes for air suction 29 roughly at the center of the partition plate 27 into the circulation fan chamber 25. Accordingly, a circulation path is formed in the heating chamber 11 and the circulation fan chamber 25. The ventilating holes for blast 31 are not made in the lower portion of the placement position of the circulation fan 17 of the partition plate 27 and the generated steam is guided into the ventilating holes for air suction 29. The steam circulates in the heating chamber 11 as indicated by hollow arrows in the figure, whereby the steam is blown on the heated material M.

In the preheat step P1, the steam generation section 15 is turned on just now and the steam concentration in the heating chamber 11 is low and temperature measurement of the heated material M conducted by the infrared sensor 20 is not hindered at all.

At the termination of the preheat step P1, then control goes to heated material determination step P2 (S3). In the heated material determination step P2, the circulation fan 17 remains on, the high-frequency heating is on with low output, and the steam generation section 15 remains on. Setting the high-frequency heating to low output means that the high-frequency heating is set to output of about 300 to 500 W if the maximum output of the apparatus is 1000 W, for example. As the high-frequency heating is set to low output, overheating can be prevented even if the load is small in the step P2. The infrared sensor 20 always measures the temperature of the heated material M.

In the heated material determination step P2, before the steam concentration in the heating chamber 11 increases and temperature measurement of the heated material M conducted by the infrared sensor 20 is hindered, temperature measurement of the heated material M is completed, the initial temperature is determined by the measured temperature data, and temperature rise rate ΔT of the heated material M is calculated.

Figure 32A:
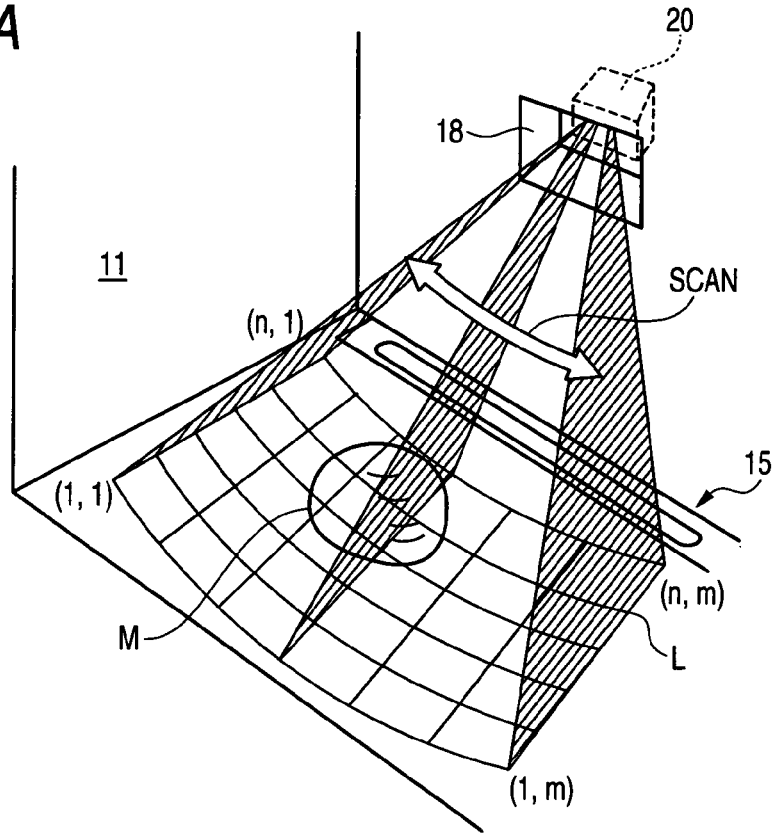
FIG. 32A is a perspective view to show the state of heated material temperature measurement conducted by an infrared sensor and FIG. 32B is a graph to show the temperature measurement result.

The temperature measurement of the heated material M will be discussed with reference to FIG. 32. The heated material M is placed in the heating chamber 11. At the heating start time, what position on the heating chamber bottom the heated material M is placed at is unknown. Then, the position of the heated material M is located from the temperature distribution in the heating chamber 11 provided by the infrared sensor 20. That is, as shown in FIG. 32A, while the infrared sensor 20 detects temperatures at a plurality of points (n points) at a time, the infrared sensor 20 itself is swung for scanning in the arrow direction and the infrared sensor 20 detects temperatures at a plurality of measurement points (m points in the scan direction) in the heating chamber 11. Therefore, temperature detection at n×m measurement points shown in FIG. 32B can be conducted through one scan.

Figure 32B:
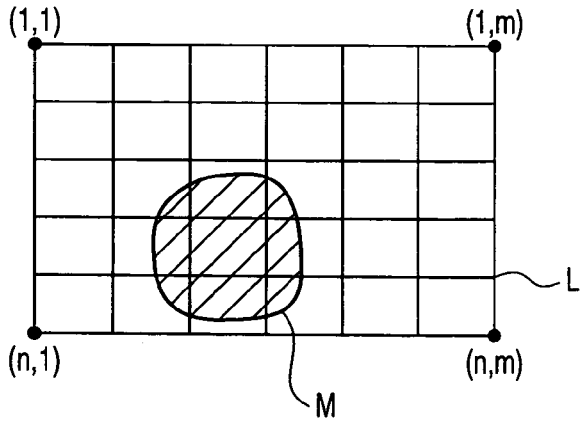

As seen from the temperature distribution in the heating chamber 11 measured by one scan of the infrared sensor 20 shown in FIG. 32B, usually the temperature at the place where the heated material M exists is detected as a different temperature from that in any other portion and thus the position of the heated material M in the heating chamber 11 can be detected. For example, if the heated material M is a frozen article, a low temperature as compared with the temperature at the bottom of the heating chamber 11 is detected; if the heated material M is an article stored at room temperature, a higher temperature than that at the bottom is detected with heating.

Figure 33:
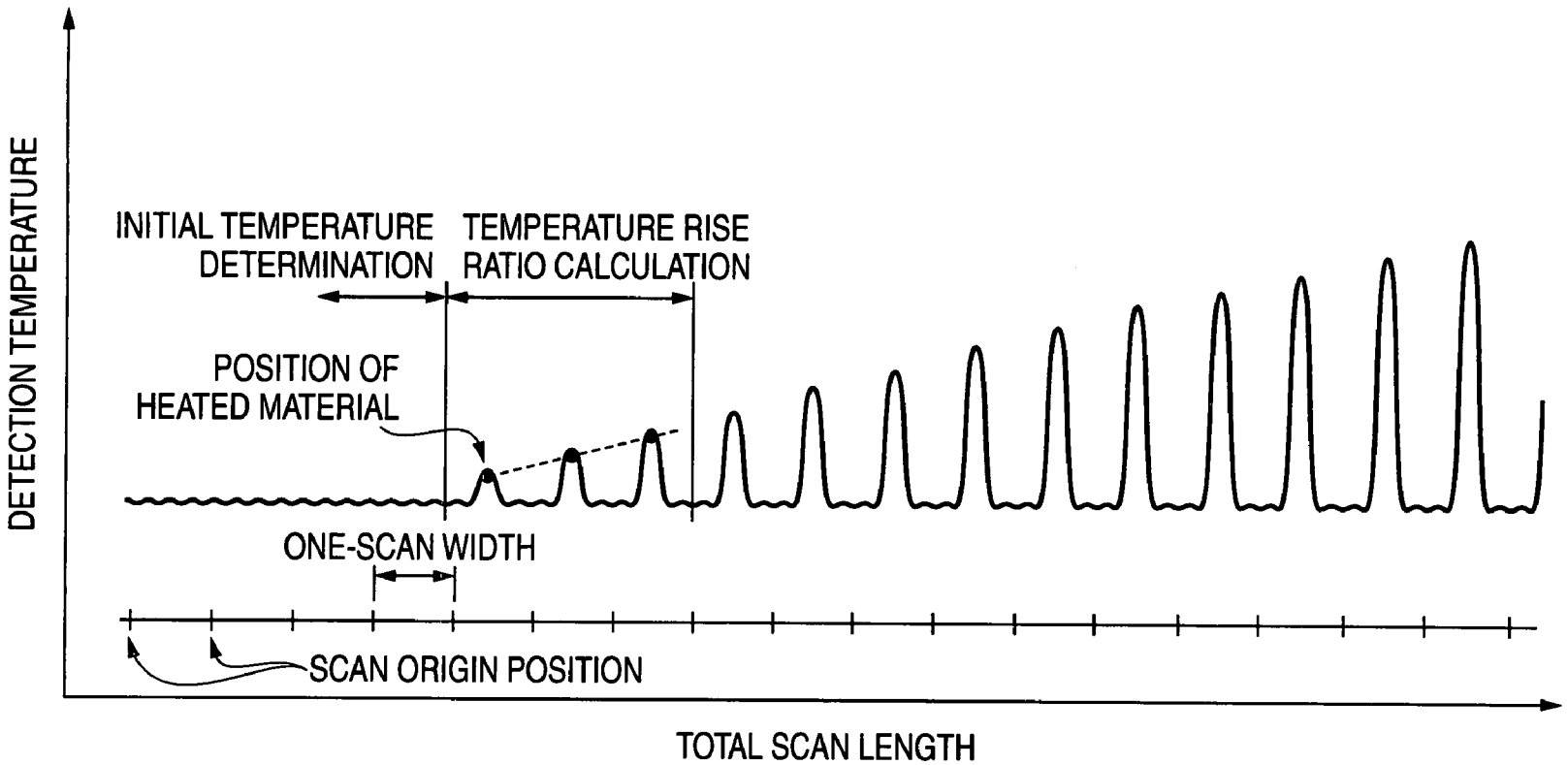
FIG. 33 is a graph to show the temperature distribution at L line position in FIG. 32B when scan of the infrared sensor is executed consecutively.

FIG. 33 shows the temperature distribution at L line position in FIG. 32B when scan of the infrared sensor 20 is executed a plurality of times consecutively. In FIG. 33, the peak position of the temperature distribution where the temperature particularly changes within the one-scan width corresponds to the position of the heated material M on the L line in FIG. 32B. Therefore, the position of the heated material M in the heating chamber 11 can be found from the peak existence position of the temperature distribution. The temperature corresponding to the position of the heated material M is found-retroactively to the initial time of the heating or the temperature measurement start time, and the initial temperature of the heated material M is determined. If the initial temperature is equal to or less than a predetermined temperature, the heated material M is determined a frozen article; if the initial temperature exceeds the predetermined temperature, the heated material M is determined an article stored at room temperature.

Figure 34:
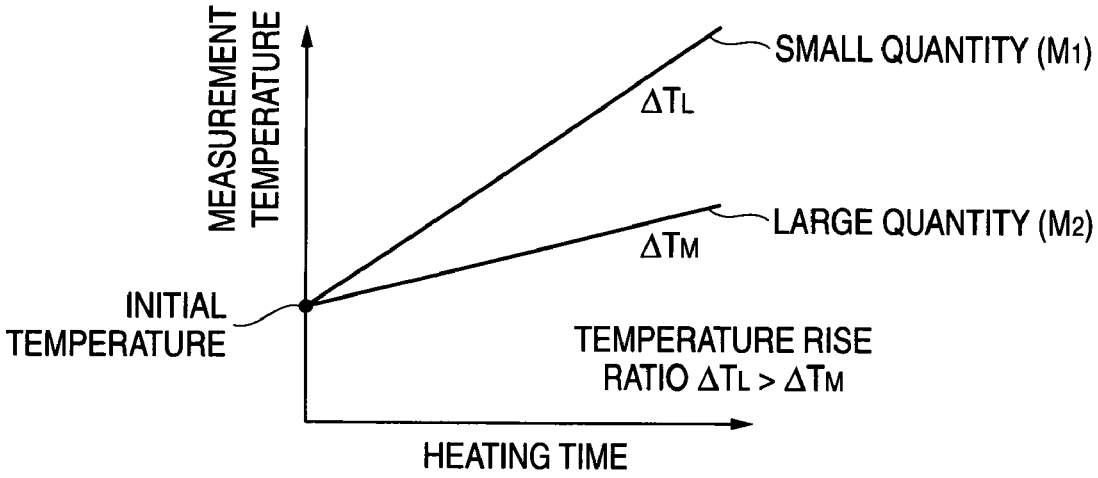
FIG. 34 is a graph to show the relationship between the heating time and the measurement temperature based on the quantity difference.

Upon completion of the determination of the initial temperature, the temperature rise rate ΔT of the heated material M is found from the gradient of the line connecting the peaks of the temperature distribution curve in FIG. 33 (dotted line in the figure). The quantity of the heated material M is estimated according to the temperature rise rate ΔT. The quantity is estimated using the fact that if two heated materials M1 and M2 different in weight at the same initial temperature are heated under the same conditions, the materials M1 and M2 differ in temperature rise rate ΔT in response to the weight, as shown in FIG. 34. For example, to heat the heated material M1 of a small quantity, the temperature rise rate becomes ΔTL; to heat the heated material M2 of a large quantity, the temperature rise rate becomes ΔTM small than ΔTL.

The determination of the initial temperature of the heated material M and the estimation of the quantity of the heated material M from the temperature rise rate ΔT are thus complete and the heated material determination step P2 is terminated. If it is determined that the quantity of the heated material M is large, additional humidification step P3 is executed (S4). The humidifying time in the additional humidification step P3 is set in response to the temperature rise rate ΔT. For example, it is found as K1/ΔT (where K1 is a constant). The maximum heating time responsive to the quantity of the heated material M is also set. In the subsequent heating treatment, when the total heating time exceeds the maximum heating time, the heating treatment is forcibly terminated. Accordingly, overheating can be prevented for ensuring the safety of the apparatus.

In the additional humidification step P3, if the circulation fan 17 is continuously rotated, the heated material M may be cooled by circulation air and thus the circulation fan 17 is switched off. The high-frequency heating is maintained in the low output state and the steam generation section 15 also remains on for supplying steam to the heating chamber 11. Although the steam density is high in the heating chamber 11 at this time, necessary temperature measurement is already complete and thus temperature measurement is not conducted by the infrared sensor 20 at this point in time. Alternatively, if temperature measurement is conducted, the temperature measurement result is not used for control.

The preheat step P1, the heated material determination step P2, and the additional humidification step P3 are collectively called initial humidification step. When the initial temperature is low as the heated material M is a frozen article or when the quantity of the heated material M is large, if the time of the initial humidification step is prolonged, shortage of water in the subsequent main heating step is avoided. In the initial humidification step, as large amount of moisture as possible is penetrated into the surface of the heated material, whereby heating unevenness can be improved. On the other hand, when the heated material M is an article stored at room temperature or has a small quantity, the time of the initial humidification step is shortened, whereby humidification with no waste can be performed in a short time.

After the termination of the additional humidification step P3, main heating step P4 is started (S5). In the main heating step P4, the circulation fan 17 is turned on, the steam generation section 15 is turned off, and the high-frequency heating is performed with output setting of the high-frequency heating responsive to the previously detected quantity of the heated material M. For example, if the quantity of the heated material M is large or the heated material M is determined a frozen article, output of the high-frequency heating is raised for strong heating.

At this time, if the output of the high-frequency heating is raised, it is made possible to use up to roughly the maximum output of the apparatus as the output of the high-frequency heating because the steam generation section 15 consuming large power is turned off. Therefore, heating treatment with the heating power maximized can be performed. In the main heating step P4, a considerable amount of steam is supplied to the heating chamber 11 in the preceding humidification step and shortage of the steam density does not occur.

As the main heating step P4 proceeds, the steam density in the heating chamber 11 tends to gradually decrease because steam supply stops. On the other hand, steam is generated from the heated material M and thus the necessary amount of steam always exists in the heating chamber 11. When the heating material M becomes close to the finish temperature, the steam density falls within the range in which the infrared sensor 20 can measure temperature. Then, monitoring the temperature measurement result of the infrared sensor 20 is started. If the infrared sensor 20 measures the temperature of the heated material M and detects the heated material M being heated to a predetermined finish temperature, the main heating step P4 is terminated. At this time, temperature unevenness of the heated material M is also detected.

Detection of temperature unevenness of the heated material M will be discussed. Usually, in the high-frequency heating, if the heated material M is a frozen article, if the quantity of the heated material M is comparatively large, or if the heated material M is heated rapidly under a large load, temperature unevenness such that the temperature in a marginal part of the heated material M becomes higher than the temperature at the center of the heated material M may occur. Then, the difference between the temperature in the marginal part of the heated material M and the temperature at the center of the heated material M is found and if the temperature difference is larger than a predetermined allowed value, the temperature unevenness is determined large.

Figure 35B:
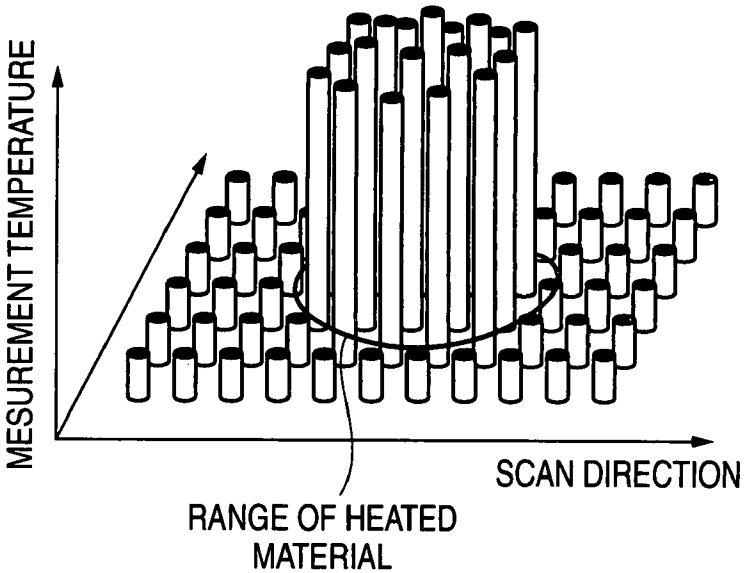
FIGS. 35A and 35B are graphs to show measurement temperatures detected by the infrared sensor.
Figure 35A:
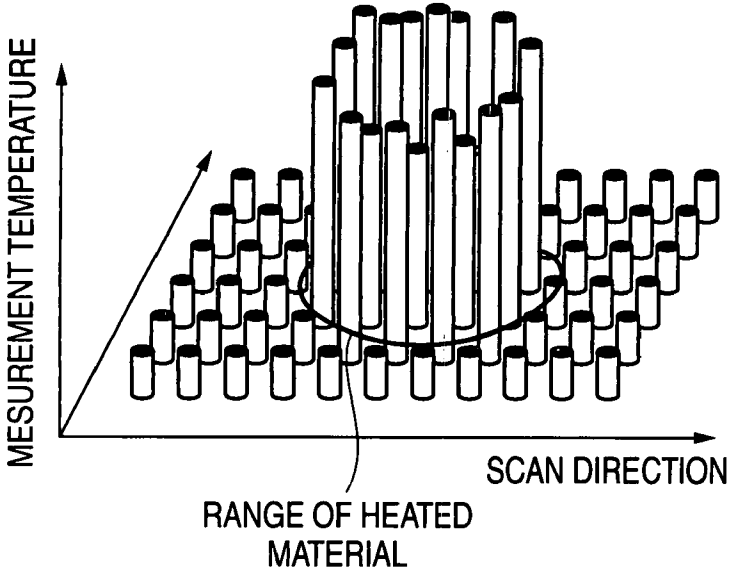

That is, when the temperature in the heating chamber 11 is scanned by the infrared sensor 20, if the temperature in the marginal part of the heated material M is high and the temperature at the center is low as shown in FIG. 35A, it is determined that temperature unevenness exists. On the other hand, if the marginal part and the center are uniformly heated for raising the temperature as shown in FIG. 35B, it is determined that no temperature unevenness exists. If it is determined that the heated material M does not contain temperature unevenness, additional heating is not performed. On the other hand, if it is determined that the heated material M contains temperature unevenness, additional heating is performed.

If it is determined that additional heating is required, additional heating step P5 is performed (P6). In the additional heating step P5, the circulation fan 17 is turned off to avoid cooling of the heated material M, the high-frequency heating is turned on with low output, and the steam generation section 15 is turned on for humidifying the heated material M to remove temperature unevenness. The additional heating time is set in proportion to the heating time in the main heating step P4 and is found, for example, from T1·K2 (where K2 is a constant). Usually, when the quantity of the heated material M is large, when the initial temperature is low as the heated material M is a frozen article, or when the heated material M is heated rapidly under a large load, the additional heating step P5 is executed for the longer time.

After additional heating is performed for a predetermined time in the additional heating step P5 or if the additional heating step P5 is not required, the additional heating step P5 is skipped and heating termination step P6 (S5) is performed after the termination of the main heating step P4. In the heating termination step P6 (S5), the circulation fan 17, the high-frequency heating, and the steam generation section 15 are all turned off and the heating treatment is terminated.

Thus, according to the heating control method of the high-frequency heating apparatus and the high-frequency heating apparatus of the embodiment, the initial temperature determination of the heated material M is completed by the time the heating chamber 11 is filled with steam, so that the accurate determination of the initial temperature can be made by the infrared sensor 20. Before the heating chamber 11 is filled with steam, the temperature rise rate is calculated and the quantity of the heated material M is estimated from the temperature rise rate, so that automatically the strength of the heating treatment can be set properly based on the quantity of the heated material M without a weight sensor.

In the main heating step P4 as the main of the steam heating, the steam generation section 15 is turned off so that steam is not supplied to the heating chamber 11. Thus, the steam concentration gradually decreases and it is made possible to conduct temperature measurement of the heated material M by the infrared sensor 20 even during the heating treatment. Accordingly, finish sensing can be performed precisely. Up to roughly the maximum output of the apparatus can be consumed for the high-frequency heating and the heating treatment with a wide output range width and high flexibility can be performed. In the main heating step P4, the necessary amount of steam exists in the heating chamber 11 and thus excessive moisture of the heated material M is not evaporated.

Whether or not the heated material M is a frozen article is determined based on the initial temperature of the heated material M, the quantity of the heated material M is estimated based on the temperature rise rate, whether or not the additional humidification step P3 and the additional heating step P5 are required is determined, and if necessary, the execution time is also set. Thus, drying or hardening the surface of the heated material can be prevented without wrapping the heated material M in wrap film, occurrence of temperature unevenness can be suppressed, and the heated material M can be heat-treated in good quality without wrapping the heated material M in wrap film. Proper heating treatment can be automatically executed regardless of a frozen article or an article stored at room temperature.

The additional supply time of steam is determined corresponding to the heating time at the main high-frequency heating time. Thus, if the heating time is long, the additional supply time of steam can be prolonged for performing adequate humidification responsive to the heating condition. When additional steam is supplied, low-output heating with a high frequency is also performed, so that the inside of the heated material M can also be heated and temperature unevenness can be eliminated.

EMBODIMENT 3

Next, a third embodiment for controlling so that temperature measurement of the infrared sensor 20 of the high-frequency heating apparatus is conducted within the time previously registered in a database.

In the embodiment, control is performed so that temperature measurement at the initial stage of heating in the second embodiment is conducted within a prescribed time. If the heating chamber is filled with steam at a predetermined concentration or more, it is made substantially impossible for the infrared sensor 20 to measure the temperature of a heated material. The time until the temperature measurement is made impossible from the steam occurrence time (temperature measurement limit time) changes depending on the conditions of the volume of the heating chamber 11, the supply amount of water to the evaporation pan 35, output of the evaporation pan heater 37, etc. Then, the time until the temperature measurement is made impossible under the conditions is previously found out experimentally and its information is retained in the storage section 505 as a database. At the actual heating treatment time, the time responsive to the heating conditions is found from the information retained in the database, and temperature measurement of the infrared sensor 20 is completed before the expiration of the time.

The temperature measurement is thus conducted within the specified time, whereby it is made possible to reliably and precisely measure the temperature of the heated material without being affected by steam in the heating chamber.

The specific database contents will be discussed by way of example, but the invention is not limited to the method.

Figure 37:
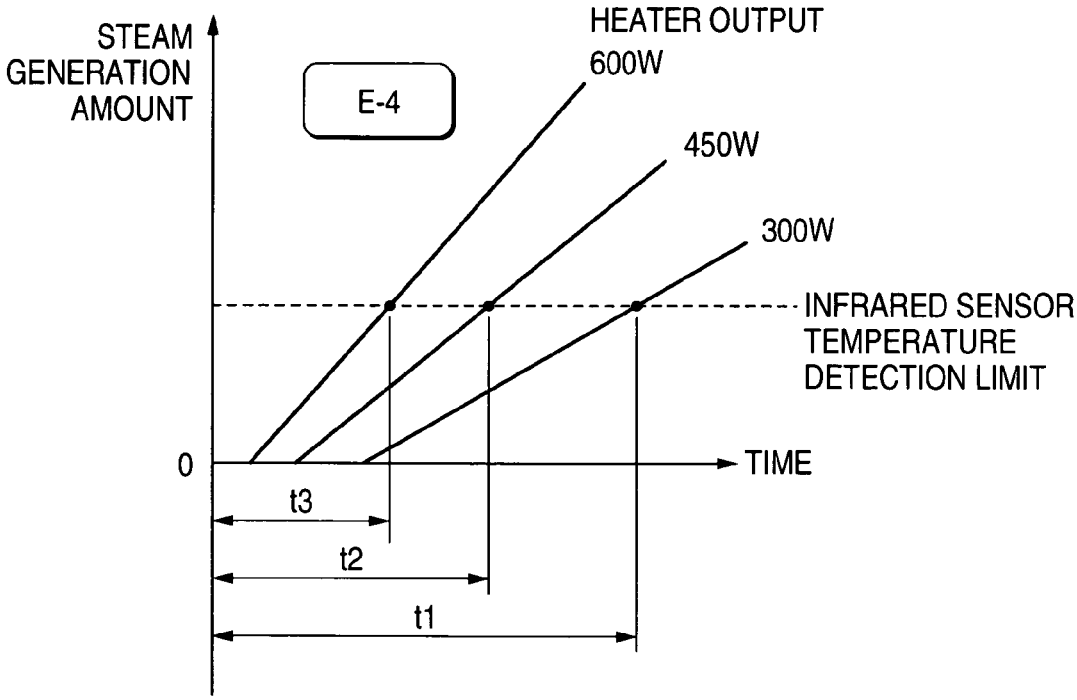
FIG. 37 is a schematic representation to show the contents of the selected table.
Figure 38:
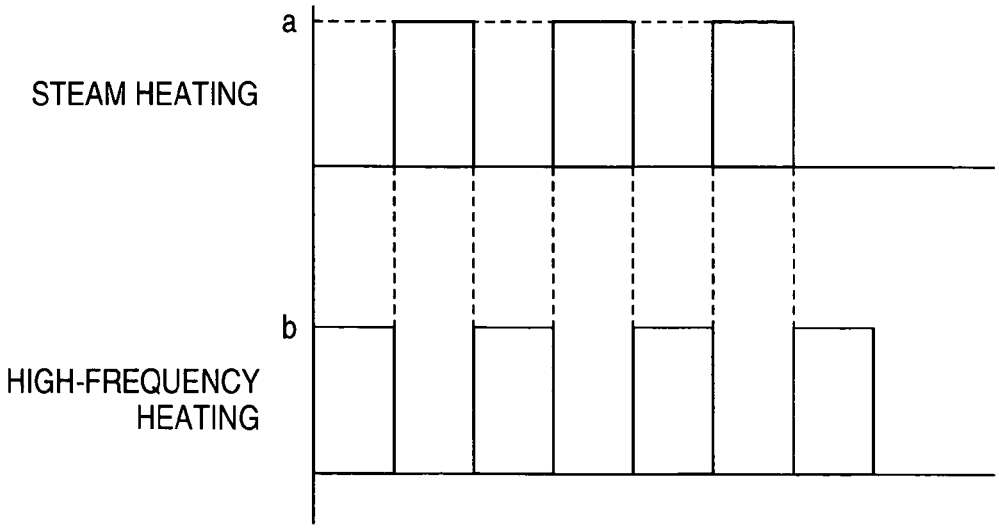
FIG. 38 is a time chart of the control contents in a related art.

FIG. 36 is a schematic representation to show a lookup table to select one table from the relationship between the volume of the heating chamber 11 and the amount of water in the evaporation pan 35. FIG. 37 is a schematic representation to show the contents of the selected table.

As shown in FIG. 36, the volumes of the heating chamber 11 are ranked in A, B, C, D, E, . . . with an arbitrary width and the amounts of water in the evaporation pan 35 are classified into levels (1, 2, 3, 4, 5, . . . ). Tables classified into levels (A-1 to F-5, etc.,) are provided for each rank of the heating chamber volume.

The characteristics of the steam generation amount previously found by experiment, etc., are entered in each table. That is, as shown in FIG. 37, for example, output of the evaporation pan heater 37 is any setup value of 300 [W], 450 [W], 600 [W], etc., and change relative to the elapsed time of the steam generation amount found for each output setup value is found and is registered. The registration contents also include the times until the temperature detection limit of the infrared sensor is reached, t1, t2, and t3.

Now, assume that the volume of the heating chamber 11 is 30 [l], that the amount of water in the evaporation pan 35 is 45 [ml], and that output of the evaporation pan heater 37 is 450 W. In this case, lookup table E-4 shown in FIG. 36 is selected and the E-4 table shown in FIG. 37 is referenced. As shown in FIG. 37, according to the steam generation characteristics in E-4, when the output of the evaporation pan heater 37 is 450 W, the temperature detection limit of the infrared sensor 20 is reached after the expiration of the time t2 since the heating start. Thus, in the condition, heat control wherein the termination time of the heated material determination step P2 shown in FIG. 31 is set to the expiration time of the time t2 or within the time t2 is performed. Accordingly, if the heating condition is changed, the temperature measurement of the heated material can be performed furthermore precisely and the time to the temperature detection limit can be set by performing simple table reference processing, so that the calculation load on the control section can be lightened and quick setting is made possible.

In addition, a numerical expression may be preset, for example, with various conditions of the heating chamber volume, the amount of water in the evaporation pan, output of the evaporation pan heater, etc., as parameters, and the temperature measurement time of the infrared sensor 20 at the actual heating treatment time may be determined based on the numerical expression. In this case, the capacity of the database can be suppressed to a small capacity.

Further, in the embodiment, when the steam concentration in the heating chamber 11 exceeds the temperature detection possible range of the infrared sensor 20 during the heating in the second embodiment, the air in the heating chamber 11 is aggressively circulated or replaced for a stipulated adjustment time or with the state intact, after the steam concentration lowers within the temperature detection possible range, temperature measurement is conducted.

If the heating chamber is filled with steam at a predetermined concentration or more, it is made substantially impossible for the infrared sensor 20 to measure the temperature of a heated material. Then, the air in the heating chamber 11 is circulated or replaced, or with the state intact, the steam concentration in the heating chamber 11 is lowered to the temperature detection possible range. The adjustment time required for this changes with the conditions in the heating chamber 11, such as the air amount for air circulation or replacement, etc. Thus, the adjustment time until temperature measurement is made possible, changing depending on the conditions is previously found out experimentally and its information is retained in the storage section 505 as a database. At the actual heating treatment time, the adjustment time responsive to each condition is found from the information retained in the database. The temperature measurement of the infrared sensor 20 is stopped or the measurement result is invalidated for the adjustment time, and the temperature measurement is conducted after the expiration of the adjustment time. Accordingly, the temperature of the heated material can be measured reliably and precisely without being affected by steam in the heating chamber.

The heating control method of the high-frequency heating apparatus and the high-frequency heating apparatus of the invention are not limited to the embodiments and appropriate deformations, improvement, and the like are possible.

The present invention has been explained in detail by referring to a specific embodiment. However, it would be apparent to one having ordinary skill in the art that the present invention can be variously changed or modified without departing from the spirit and scope of the invention.

The present application is based on Japanese Patent Application No. 2002-67036 filed on Mar 12, 2002 and Japanese Patent Application No. 2002-164836 filed on Jun. 5, 2002, and the content thereof is referred to and taken in here.

INDUSTRIAL APPLICABILITY

As described above, according to the control method of the high-frequency heating apparatus with steam generation function according to the invention, the air in the heating chamber is circulated while it is agitated at the heating treatment time and thus steam can be spread uniformly to the corners of the heating chamber. Therefore, although the heating chamber is filled with steam, the steam does not build up and is spread in the heating chamber. Consequently, the temperature measurement accuracy of the heated material by the infrared sensor can be enhanced, and proper heating treatment can be performed.

A frozen article and a refrigerated article are automatically distinguished from each other according to the measurement result of the temperature detection sensor, and the heating method is changed in response to the distinguishing result. Thus, an appropriate heating program can be automatically selected for execution in response to the type of object to be heated.

Further, according to the heating control method of the high-frequency heating apparatus and the high-frequency heating apparatus according to the invention, the infrared sensor measures the temperature of the heated material by the time the heating chamber is filled with steam, so that the temperature of the heated material can be precisely found without being affected by the steam. When the high-frequency main heating is performed, supplying steam to the heating chamber is stopped, thereby suppressing an increase in the steam concentration in the heating chamber more than necessary, and it is also made possible to detect the temperature of the heated material by the infrared sensor when the high-frequency main heating is performed. Since the strength of heating, additional heating, etc., is set arbitrarily based on the initial temperature provided by the infrared sensor and the temperature rise rate, drying or hardening the surface of the heated material can be prevented without wrapping the heated material in wrap, etc., and temperature unevenness can also be prevented.

What is claimed is:

1. A control method of a high-frequency heating apparatus with steam generation function for supplying a high frequency and steam to a heating chamber for storing a heated material and heat-treating the heated material, comprising the steps of:

heat-treating the heated material by performing high-frequency heating treatment for heat-treating with a high frequency and steam heating treatment for heat-treating with steam generated in the heating chamber in order separately or at the same time for heat-treating the heated material;

agitating air in the heating chamber to circulate the air in the heating chamber when the heat-treating is performed;

measuring the temperature in the heating chamber by a temperature detection sensor;

storing the temperature measurement result in a storage section;

comparing frozen food determination temperature preset in the storage section with the temperature measurement result; and selecting a heating program, wherein a heating program for performing high-frequency heating treatment and then switching to steam heating treatment for heating the heated material is selected when the temperature measurement result is higher than the frozen food determination temperature, and a heating program for performing high-frequency heating treatment and steam heating treatment at the same time and then stopping only the high-frequency heating treatment to execute the steam heating treatment to heat the heated material when the temperature measurement result is equal to or less than the frozen food determination temperature, wherein said step of heat-treating the heated material is performing based on the selected heating program.

2. The control method of the high-frequency heating apparatus with steam generation function as claimed in claim 1, further comprising heating the air circulated in the heating chamber by a chamber air heater at the heat-treating the heated material.

3. With steam generation function as claimed in claim 2, wherein the high-frequency heating treatment is heating treatment in which an inverter variably controls the heating power amount, and the steam heating treatment and the high-frequency heating treatment are performed at the same time so that the sum of the heating power amount of the steam heating treatment and the chamber air heater and the heating power amount of the high-frequency heating treatment becomes a predetermined rated power amount or less.

4. The control method of the high-frequency heating apparatus with steam generation function as claimed in claim 1, wherein the heating chamber has an outlet with a door comprising a light-transmitting window in a part in a manner that it can be opened and closed and an air outlet for blowing outside air on the window of the door on the heating chamber inside is disposed on a side wall of the heating chamber.

5. A heating control method of a high-frequency heating apparatus for supplying at least either of a high frequency and steam to a heating chamber for storing a heated material and heat-treating the heated material and, measuring temperature of the heated material by an infrared sensor and monitoring the heating state, said heating control method comprising the steps of:

measuring the temperature of the heated material by the infrared sensor a plurality of times and finding a temperature rise rate to the heating time of the heated material at a time of an initial humidification at which steam is supplied to the heating chamber and low-output heating with a high frequency is performed;

after the termination of the initial humidification, stopping supplying steam to the heating chamber and performing high-frequency main heating according to a heating condition responsive to the quantity of the heated material estimated from the temperature rise rate; and when the infrared sensor detects specified finish temperature of the heated material during the high-frequency main heating, stopping the high-frequency main heating.

6. The heating control method of the high-frequency heating apparatus as claimed in claim 5, wherein when the quantity of the heated material is large, the an execution time of the initial humidification is set to a long time and when the quantity of the heated material is small, the execution time of the initial humidification is set to a short time.

7. The heating control method of the high-frequency heating apparatus as claimed in claim 5, wherein whether the heated material is a frozen article or an article stored at room temperature is determined from the temperature measurement result of the infrared sensor at the initial humidification time and if the heating material is a frozen article, heating at the high-frequency main heating time is set as stronger heating than that if the heating material is an article stored at room temperature.

8. The heating control method of the high-frequency heating apparatus as claimed in claim 5, wherein when the infrared sensor detects the finish temperature, additional steam is supplied to the heating chamber for a predetermined time in at least any one of the cases where (a) temperature unevenness caused by heating the heated material exceeds a predetermined allowed value;

(b) the heated material is a frozen article; and (c) the quantity of the heated material exceeds a stipulated amount.

9. The heating control method of the high-frequency heating apparatus as claimed in claim 8, wherein the supply time of the additional steam is set in proportion to the heating time of the high-frequency main heating.

10. The heating control method of the high-frequency heating apparatus as claimed in claim 8, wherein when the additional steam is supplied to the heating chamber, low-output heating with a high frequency is performed together.

11. The heating control method of the high-frequency heating apparatus as claimed in claim 5, wherein air in the heating chamber is agitated by a circulation fan at the same time as the high-frequency main heating time.

12. The heating control method of the high-frequency heating apparatus as claimed in claim 5, wherein air in the heating chamber is agitated by a circulation fan at the same time as the initial humidification time.

13. The heating control method of the high-frequency heating apparatus as claimed in claim 5, wherein the maximum heating time responsive to the quantity of the heated material is set and when the elapsed time since the heating start reaches the maximum heating time, the heating treatment is forcibly terminated.

14. A heating control method of a high-frequency heating apparatus comprising the steps of:

supplying at least either of a high frequency and steam to a heating chamber for storing a heated material and heat-treating the heated material;

measuring temperature of the heated material by an infrared sensor and monitoring the heating state, wherein the step of measuring temperature of the heated material is conducted by the infrared sensor is performed within preset measurement time after the heating start;

obtaining temperature measurement limit time of the infrared sensor changing in response to at least any of volume of the heating chamber, the amount of water supplied for steam generation, and an output value of a heating source for heating the water;

registering each found temperature measurement limit time in a table; and setting the measurement time by referring the table.

15. A heating control method of a high-frequency heating apparatus comprising the steps of:

supplying at least either of a high frequency and steam to a heating chamber for storing a heated material and heat-treating the heated material; and measuring temperature of the heated material by an infrared sensor and monitoring the heating state, wherein the temperature measurement of the infrared sensor is stopped or the measured temperature is invalid when steam concentration in the heating chamber exceeds the temperature detection possible range of the heated material by the infrared sensor, and the temperature measurement of the infrared sensor is started or the measured temperature is valid after the steam concentration lowers within the temperature detection possible range.

16. The heating control method of the high-frequency heating apparatus as claimed in claim 15, further comprising the steps of:

obtaining adjustment time until the steam concentration lowers in the temperature detection possible range in response to various conditions in the heating chamber;

registering each found adjustment time in a table; and setting the adjustment time by referring the table.

17. A high-frequency heating apparatus comprising:

a high-frequency generation section for supplying a high frequency to a heating chamber for storing a heated material;

a steam generation section for supplying steam to the heating chamber;

an air outlet provided on a sidewall of the heating chamber to allow outside air to blow into the heating chamber and on to a door having a light-transmitting window;

an infrared sensor for detecting temperature in the heating chamber through a detection hole made in a wall of the heating chamber; and a control section for controlling the high-frequency generation section, the steam generation section and the infrared sensor, wherein the control section determines the temperature of the heated material and selects a first program if the temperature of the heated material is higher than a frozen food determination temperature and selects a second program if the temperature of the heated material is lower than the frozen food determination temperature.

18. The high-frequency heating apparatus as claimed in claim 17, wherein said steam generation section is disposed at a position substantially out of the temperature detection range of said infrared sensor.

19. A high-frequency heating apparatus comprising:

a high-frequency generation section for supplying a high frequency to a heating chamber for storing a heated material;

a steam generation section for supplying steam to the heating chamber;

an air outlet provided on a sidewall of the heating chamber to allow outside air to blow into the heating chamber and on to a door having a light-transmitting window;

a circulation fan for agitating air in the heating chamber;

an infrared sensor for detecting temperature in the heating chamber through a detection hole made in a wall of the heating chamber; and a control section for controlling the high-frequency generation section, the steam generation section, the circulation fan and the infrared sensor, wherein the control section determines the temperature of the heated material and selects a first program if the temperature of the heated material is higher than a frozen food determination temperature and selects a second program if the temperature of the heated material is lower than the frozen food determination temperature.

20. The high-frequency heating apparatus as claimed in claim 19, wherein said steam generation section is disposed at a position substantially out of the temperature detection range of said infrared sensor.

* * * * *

UNITED STATES PATENT AND TRADEMARK OFFICE

CERTIFICATE OF CORRECTION

PATENT NO. : 7,166,824 B2
APPLICATION NO. : 10/432919
DATED : January 23, 2007
INVENTOR(S) : Kouji Kanzaki It is certified that error appears in the above-identified patent and that said Letters Patent is hereby corrected as shown below:

In column 30, claim 3, line 6 please delete "With" and insert therefore
--The control method of the high-frequency heating apparatus with--

In column 31, claim 14, line 30 please delete "at least either of a high frequency and"

Signed and Sealed this

Fourteenth Day of August, 2007

JON W. DUDAS
*Director of the United States Patent and Trademark Office*